US010526060B2

(12) United States Patent
Arditi

(10) Patent No.: US 10,526,060 B2
(45) **Date of Patent: *Jan. 7, 2020**

(54) ENHANCED SYSTEM AND METHOD FOR REMOTELY DEPLOYING BOAT FENDERS

(71) Applicant: Shmuel Sam Arditi, Discovery Bay, CA (US)

(72) Inventor: Shmuel Sam Arditi, Discovery Bay, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/130,968

(22) Filed: Sep. 13, 2018

(65) Prior Publication Data

US 2019/0112015 A1 Apr. 18, 2019

Related U.S. Application Data

(63) Continuation-in-part of application No. 15/709,421, filed on Sep. 19, 2017, now Pat. No. 10,266,242, and a continuation-in-part of application No. 15/369,803, filed on Dec. 5, 2016, said application No. 15/709,421 is a continuation of application No. 15/237,603, filed on Aug. 15, 2016, now Pat. No. 9,764,808, which is a continuation-in-part of application No. 15/178,515, filed on Jun. 9, 2016, now Pat. No. 9,738,358, said application No. 15/369,803 is a continuation of application No. 15/178,515, which is a continuation-in-part of application No. 15/054,125, filed on Feb. 25, 2016, now Pat. No. 9,409,637, and a continuation-in-part of application No. 14/981,858, filed on Dec. 28, 2015, now Pat. No. 9,598,157, which is a continuation-in-part of application No. 14/929,369, filed on Nov. 1, 2015, now Pat. No. 9,440,716.

(60) Provisional application No. 62/360,966, filed on Jul. 12, 2016, provisional application No. 62/200,089, filed on Aug. 2, 2015, provisional application No. 62/165,798, filed on May 22, 2015, provisional application No. 62/157,857, filed on May 6, 2015, provisional application No. 62/153,185, filed on Apr. 27, 2015, provisional application No. 62/153,193, filed on Apr. 27, 2015, provisional application No. 62/148,725, filed on Apr. 16, 2015.

(51) Int. Cl.
*B63B 59/02* (2006.01)

(52) U.S. Cl.
CPC ..... *B63B 59/02* (2013.01)

(58) Field of Classification Search
CPC ..... B63B 59/00; B63B 59/02
USPC ..... 114/218, 219, 220
See application file for complete search history.

(56) References Cited

U.S. PATENT DOCUMENTS 9,409,637 B1 * 8/2016 Arditi ..... B63B 59/02
9,440,716 B1 * 9/2016 Arditi ..... B63B 59/02
9,598,157 B2 * 3/2017 Arditi ..... B63B 59/02
9,738,358 B2 * 8/2017 Arditi ..... B63B 59/02
(Continued)

*Primary Examiner* — Lars A Olson
(74) *Attorney, Agent, or Firm* — Brian R. Galvin; Brian S. Boon; Galvin Patent Law, LLC

(57) ABSTRACT

An enhanced system and various methods for remotely deploying boat fenders from a safe and convenient location. The boat fenders, which are placed along the entire periphery of the boat, may be deployed and retracted with lines attached to winches and motors. A smart phone app may be employed to remind users to deploy boat fenders upon entering known ports, and may also deploy the boat fenders automatically.

22 Claims, 24 Drawing Sheets

(56) References Cited

U.S. PATENT DOCUMENTS

| | | | | |
|---|---|---|---|---|
| 9,764,808 | B2 * | 9/2017 | Arditi | B63B 59/02 |
| 10,266,242 | B2 * | 4/2019 | Arditi | B63B 59/02 |

* cited by examiner

400

1100

2300

ENHANCED SYSTEM AND METHOD FOR REMOTELY DEPLOYING BOAT FENDERS

CROSS-REFERENCE TO RELATED APPLICATIONS

This application claims priority to and benefit of U.S. provisional patent application Ser. No. 62/711,943, titled "SYSTEM AND METHOD FOR REDUCED-COMPLEXITY FENDER POSITIONING SYSTEMS", filed on Jul. 30, 2018, and is also a continuation-in-part of U.S. patent application Ser. No. 15/709,421, titled "ENHANCED SYSTEM AND METHOD FOR DETANGLING AND PROTECTION OF AUTOMATIC FENDER POSITIONING SYSTEMS", filed on Sep. 19, 2017, which is a continuation of U.S. patent application Ser. No. 15/237,603, titled "ENHANCED SYSTEM AND METHOD FOR CONTROLLING AUTOMATIC DEPLOYMENT OF BOAT FENDERS", filed on Aug. 15, 2016, which claims benefit of, and priority to, U.S. provisional patent application 62/360,966, titled "ENHANCED SYSTEM AND METHOD FOR CONTROLLING AUTOMATIC DEPLOYMENT OF BOAT FENDERS", filed on Jul. 12, 2016, and is also a continuation-in-part of U.S. patent application Ser. No. 15/178,515, titled "ENHANCED SYSTEM AND METHOD FOR DEPLOYING BOAT FENDERS SAFELY AND CONVENIENTLY", filed on Jun. 9, 2016, which is a continuation-in-part of U.S. patent application Ser. No. 15/054,125, titled "ENHANCED SYSTEM AND METHOD FOR REMOTELY DEPLOYING BOAT FENDERS", filed on Feb. 25, 2016, and is also a continuation-in-part of U.S. patent application Ser. No. 14/981,858, titled "ENHANCED SYSTEM AND METHOD FOR DETANGLING AND PROTECTION OF AUTOMATIC FENDER POSITIONING SYSTEMS", filed on Dec. 28, 2015, both of which claim priority to U.S. provisional patent application Ser. No. 62/148,725, titled "SYSTEM AND METHOD FOR SAFELY AND CONVENIENTLY DEPLOYING BOAT FENDERS", filed on Apr. 16, 2015, and to U.S. provisional patent application Ser. No. 62/153,185, titled "ENHANCED SYSTEM AND METHOD FOR AUTOMATICALLY DEPLOYING BOAT FENDERS 2", filed on Apr. 27, 2015, and to U.S. provisional patent application Ser. Nos. 62/157,857, titled "SYSTEM AND METHOD FOR REDUCING THE PROFILE OF BOAT FENDER BASKETS", filed on May 6, 2015, and to 62/165,798, titled "AUTOMATIC BOAT FENDER BASKETS", filed on May 22, 2015, and to 62/200,089, titled "AUTOMATIC BOAT FENDER LINE GUIDE, CAMERA AND MORE", filed on Aug. 2, 2015, and also is a continuation-in-part of U.S. patent application Ser. No. 14/929,369, titled "ENHANCED SYSTEM AND METHOD FOR AUTOMATICALLY DEPLOYING BOAT FENDERS", filed on Nov. 1, 2015, which claims benefit of, and priority to, U.S. provisional patent application Ser. No. 62,153,193, titled "ENHANCED SYSTEM AND METHOD FOR AUTOMATICALLY DEPLOYING BOAT FENDERS", filed on Apr. 27, 2015. The disclosure of each of the above-referenced patent applications is incorporated herein by reference in its entirety.

This application is also a continuation-in-part of U.S. patent application Ser. No. 15/369,803, titled "ENHANCED SYSTEM AND METHOD FOR REMOTELY DEPLOYING BOAT FENDERS", filed on Dec. 5, 2016, which is a continuation of U.S. patent application Ser. No. 15/178,515, titled "ENHANCED SYSTEM AND METHOD FOR DEPLOYING BOAT FENDERS SAFELY AND CONVENIENTLY", filed on Jun. 9, 2016, the entire specifications of each of which are incorporated herein by reference.

BACKGROUND OF THE INVENTION

Field of the Invention

The disclosure relates to the field of boating, and more particularly to the field of deploying protective fenders for use in docking a boat.

Discussion of the State of the Art

Boating, in a motorized or sail-powered craft, is both a popular recreational activity and the foundation of the seafood industry. The operator of the craft must be able to navigate it safely and also to dock it safely, whether at a stationary, land-based dock, next to another boat, or at some other, similar large adjacent object (any and all of which are hereinafter referred to as a "dock"). In cases of stormy weather or large waves, deploying and positioning the protective boat fenders to keep the boat from violently hitting a dock can be tricky and dangerous. Deploying and positioning the protective boat fenders can be tricky and dangerous to unexperienced or older boaters even in good weather conditions. It is especially dangerous when the boat deck is wet and slippery.

What is needed is a system and method that enables a boat operator to safely and conveniently deploy boat fenders (buoys, bumpers) when needed. What is additionally needed is a way to extend and retract boat fender into and out of stowage from locations remote from the placement of at least some of those fenders, for added safety and convenience. Further needed in other cases is a way to extend and retract boat fenders using a motor-driven mechanism, for even greater added safety and convenience. Further needed is a system and method enabling a user to control these fenders from a mobile computing device, such as a smartphone or tablet. Additionally needed is a system and method to alert the user to deploy the boat's fenders when the boat is on a trajectory that leads to a previously visited dock and, in some cases, to deploy the fenders automatically, all based upon a location of the boat. Additionally needed is a system and method to alert the user to lift the boat's fenders when cruising away from the dock or accelerating.

SUMMARY OF THE INVENTION

The inventor has conceived and reduced to practice, in a preferred embodiment of the invention, an enhanced system and various methods for remotely deploying boat fenders.

In a preferred embodiment, a system is disclosed for deploying or retracting boat fenders based on deployment location and lifting scenarios, comprising: at least one motor; a controller which determines the geographical location of the boat and activates the motor or motors to raise or lower a boat fender or fenders based on the geographical location of the boat.

In another preferred embodiment, a system is disclosed for deploying or retracting a boat fender, comprising: at least one motor; at least one line fastened to the motor; and a controller which activates the motor or motors to raise or lower a boat fender and directs operation of one or more systems to raise or lower a boat fender.

BRIEF DESCRIPTION OF THE DRAWING FIGURES

The accompanying drawings illustrate several embodiments of the invention and, together with the description, serve to explain the principles of the invention according to the embodiments. One skilled in the art will recognize that the particular embodiments illustrated in the drawings are merely exemplary, and are not intended to limit the scope of the present invention.

DETAILED DESCRIPTION

Figure 1:
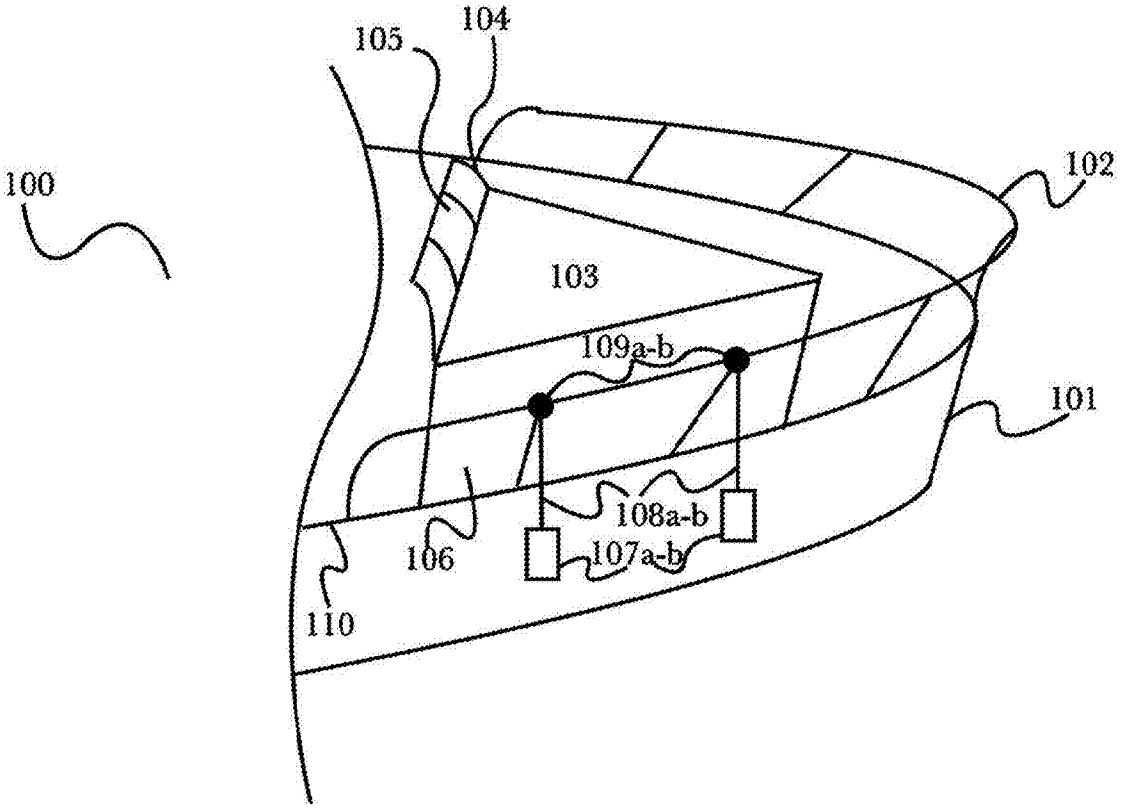
Fig. 1 (PRIOR ART)
FIG. 1 (PRIOR ART) is an illustration of a typical pleasure boat, illustrating how fenders are normally hung on a boat's railings.

The inventor has conceived, and reduced to practice, an enhanced system and method for remotely deploying boat fenders.

One or more different inventions may be described in the present application. Further, for one or more of the inventions described herein, numerous alternative embodiments may be described; it should be understood that these are presented for illustrative purposes only. The described embodiments are not intended to be limiting in any sense. One or more of the inventions may be widely applicable to numerous embodiments, as is readily apparent from the disclosure. In general, embodiments are described in sufficient detail to enable those skilled in the art to practice one or more of the inventions, and it is to be understood that other embodiments may be utilized and that structural, logical, software, electrical and other changes may be made without departing from the scope of the particular inventions. Accordingly, those skilled in the art will recognize that one or more of the inventions may be practiced with various modifications and alterations. Particular features of one or more of the inventions may be described with reference to one or more particular embodiments or figures that form a part of the present disclosure, and in which are shown, by way of illustration, specific embodiments of one or more of the inventions. It should be understood, however, that such features are not limited to usage in the one or more particular embodiments or figures with reference to which they are described. The present disclosure is neither a literal description of all embodiments of one or more of the inventions nor a listing of features of one or more of the inventions that must be present in all embodiments.

Headings of sections provided in this patent application and the title of this patent application are for convenience only, and are not to be taken as limiting the disclosure in any way.

Devices that are in connection with each other need not be continuously connected with each other, unless expressly specified otherwise. In addition, devices that are in connection with each other may connect directly or indirectly through one or more intermediaries, logical or physical.

A description of an embodiment with several components in connection with each other does not imply that all such components are required. To the contrary, a variety of optional components may be described to illustrate a wide variety of possible embodiments of one or more of the inventions and in order to more fully illustrate one or more aspects of the inventions. Similarly, although process steps, method steps, algorithms or the like may be described in a sequential order, such processes, methods and algorithms may generally also work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring sequentially (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention(s), and does not imply that the illustrated process is preferred. Also, steps are generally described once per embodiment, but this does not mean they must occur once, or that they may only occur once each time a process, method, or algorithm is carried out or executed. Some steps may be omitted in some embodiments or some occurrences, or some steps may be executed more than once in a given embodiment or occurrence.

When a single device or article is described, it will be readily apparent that more than one device or article may be used in place of a single device or article. Similarly, where more than one device or article is described, it will be readily apparent that a single device or article may be used in place of the more than one device or article.

The functionality or the features of a device may be alternatively embodied by one or more other devices that are not explicitly described as having such functionality or features. Thus, other embodiments of one or more of the inventions need not include the device itself.

Techniques and mechanisms described or referenced herein will sometimes be described in singular form for clarity. However, it should be noted that particular embodiments include multiple iterations of a technique or multiple manifestations of a mechanism unless noted otherwise. Process descriptions for computing equipment or such blocks in figures should be understood as representing modules, segments, or portions of code which include one or more executable instructions for implementing specific logical functions or steps in the process. Alternate implementations are included within the scope of embodiments of the present invention in which, for example, functions may be executed out of order from that shown or discussed, including substantially concurrently or in reverse order, depending on the functionality involved, as would be understood by those having ordinary skill in the art.

DETAILED DESCRIPTION OF EXEMPLARY EMBODIMENTS

The system and method disclosed herein uses a lift system for fenders, with retention devices providing secure stowage for fenders when not in use. Additionally, an application on a smartphone may remind the crew to lower the fenders when approaching a dock and possibly, based on previous dockings, a reminder for a mark on the line where to cleat or fast cleat the line, so the fender has the appropriate height for that dock. In some cases the application may provide a reminder or in other cases the application may actually perform the fender deployment operation (as the retention devices are motorized in those cases). In most cases the fender is positioned at the same height while docking, but in some situations different heights may be necessary.

In some cases, a retention device for stowing a fender is used, that is sometimes attached to a part of a vessel or boat, and the retention device has an opening for threading through a line (in some cases with a pulley), the line attached to a fender, the line operable by a user to pull up the fender into the retention device through a second opening at the bottom of the retention device.

In some cases, no retention device for stowing a fender is used, that is sometimes the line is attached to a part of a vessel or boat, the line attached to a fender or goes through or goes in parallel to the fender, the line operable by a user to pull up the fender into the stowed position. In such cases a stowage or retention device is not used. Typically, the system has at least one moveable, hinged section, the section formed in such a manner, that when pulling up the fender to the top, the movable section is clamping in on the fender and securing it. In some cases the retention device and the moveable section can be made of a rigid material such as a metal, suitable for marine use. In other cases a majority of the parts are made from a soft plastic material suitable for molding. In yet other cases, the parts of the retention device are made of a combination of rigid metal parts and soft plastic materials. Additionally, in some cases a fast cleat is provided to secure the line in at least two positions, one of which has the fender full retracted and at least one other having the fender deployed, and wherein the fast cleat may be mounted in an easy to reach location on the vessel. Further, an application for use on smart phone can be provided, and the application has access to a third party map system. The application has also access to the GPS system of the smartphone. When approaching a docking site the application can be used by a user to add locations used by the vessel for landing, and the user can enter a mark representing the height of the fenders deployed. In some cases, the application will display and or make heard a reminder to deploy at least one fender, and that display will include the previously stored height mark for deploying the fender. In yet other cases, the retention device for stowing a fender will have a cleat or auto cleat to allow the line to be secured at any position. In some of these cases the cleat is attached to or near the retention device. Furthermore, in some cases the cleat can be released with a controlled jerking of the line. In some cases the line may be routed inside the retention device and exit from the same opening as the fender, but it should be appreciated that according to a particular hardware arrangement the line may be able to be routed inside the retention device and exit from any point along a length of the retention device, for example through an open vertical or horizontal channel to allow the line to exit and have a degree of free movement to prevent stresses from wearing on the line or impeding movement.

In additional cases, the system and method disclosed herein uses wired or wireless communication, such as, for example, Bluetooth, to control motorized deployment and retraction of boat fenders. The mechanism can be powered by solar or the boat DC or some other power source.

In some other cases, a system may comprise a retention device for lowering one or multiple boat fenders, with the fender attached to a line that is coupled to a winch that is coupled to a motor, with the motor controlled by a controller that may be activated via wireless control signals. Power for the motor may be drawn from a battery, which may be the onboard power supply or, alternatively, may be separately charged from a solar panel. Alternatively, each retention device may have an individual controller, battery, and solar panel, not requiring any wiring between the units.

In some cases, the system and its methods enable these fenders to be controlled from a mobile computing device, such as a smartphone or tablet, both of which should be considered equivalent for all purposes here. Additionally, in some cases, based on repeated visits, the fenders can deploy automatically based on the GPS location of the boat and the fact that its trajectory leads the boat to a landing slip, berth, dock etc.

In further cases, a smartphone with an app may be used to control one or more of the retention device controllers and a multitude of automatic retention devices. The app can also control retention devices based on previous programming, without requiring user interaction, and, additionally, based on distance to a landing site derived from GPS data and map data, can prompt the user for an action and can memorize that action for future use. In some embodiments, actual fender deployment locations and tidal information pertaining to those locations may be stored for future use. Information may be stored on a server or locally. This app may include a dedicated control panel to wirelessly control one or more controllers of retention devices, using Bluetooth or Wi-Fi etc. as a wireless protocol.

In some cases, rather than a smart phone or tablet, an onboard navigation system or some other computerized boat system may be upgraded or extended to add the control functionality. This could be done via wired or wireless control of motorized buckets. For purposes, here, they all should be considered equivalent and a may have a GPS enabled computing device.

In some cases, rather than mounting a retention device to the railing, a retention device type tube could be integrated into the hull of a boat, similar to a torpedo tube and with or without an outer door protecting the fender when not in use. It may be designed outside the displacement section of the boat hull, thus eliminating complicated locks on the inside, and additionally not requiring waterproofing of the interfaces. For purposes herein, it would be considered essentially equivalent.

In additional cases, in a system with one or more retention devices for lowering one or more fenders attached to a line, each retention device may be mounted with one or more hinges so the retention device can swing out from the boat's outline, for easy deployment of a fender. Further, each retention device may be controlled for the swing-out with a lever attached to the boat and used to initiate and stop or reverse the swing-out action of the retention device. This lever may be a hinged arm and may be operated manually or by a motor. In some cases, the retention device may be mounted substantially within the boat's outline and angled so the fender may be lowered through an opening in the railing over the edge of the boat's board. The retention device, in such cases, may also have an additional slide extension at the bottom opening to extension guide the fender over the edge of the boat. The retention device may, in such cases, extend out through an opening in the railing to facilitate easier deployment of the fender, which deployment may be accomplished either manually or with the help of a motor, and the swing-out may be achieved with the help of an additional motor.

In some cases, the winch may feed the unused line into a small retention device or storage compartment that will hold the unused section. In yet other cases, a spool maybe used to wind on and store unused sections. In yet other cases, rather than normal line or rope, chains made of metal and or plastic material maybe used, and the winch may have matching grooves that garb the chain links.

In additional cases, the retention device for lowering fenders has a moveable bar across the opening; this bar, which can move along the cylindrical axis of the retention device and is pulled up alongside the fender into the retention device, has a small opening for guiding the line, as well as additional openings or features for guiding itself up and down the retention device. Further, an external force can make the retention device swing back into the hull line, counteracting at least a spring, connected to the hinge, that moves the retention device outside the hull line for normal operations. In some cases, the line may be coupled to a motor-driven winch, with the motor controlled by wired or wireless signals.

In some embodiments, the controller may control a single boat fender or more than one boat fender.

In some embodiments, at least a portion of the information required for the controller operation is received from a data source via a network, via wired connection, or via wireless connectivity, and wherein the information may or may not be real-time information.

In some embodiments, the system may further comprise a user interface. The user interface may be configured to present a user with a plurality of prompts for raising or lowering the single or plurality of boat fenders. The system may store some portion of the user interaction for future use. The application may generate a sound to accompany the displayed reminder or the user interface. In some embodiments, the system controller, based on the location information, may direct the motor after, or regardless of, an operator acknowledgement to lower the boat fender to the deployed position when the boat arrives at a dock.

In some embodiments, the system may further comprise a camera looking outward from the boat, wherein the camera is coupled to provide a video stream or a picture allowing a person to better see when approaching a docking location.

In some embodiments, at each location the system may adjust the boat fender to a specified deployment height or adjust boat fender deployment height based on the docking location.

In some embodiments, the system power may be drawn from a battery or directly from the boat. The battery may be a component of an onboard power supply or a separate component and may be recharged by a solar panel linked to the battery.

In some embodiments, after exceeding a preset limit, further attempts to detangle the line or to retrieve the fender are aborted. If fender deployment or retraction fails after the number of reversals, an alert may be provided to an operator. The detection of the failure to deploy or retract may be based on a camera with visual recognition software or a switch, and operation of the motor may be changed based on the detection.

In some embodiments, the line may be connected to the fender by a spring or elastic component or the line itself may be elastic.

In some embodiments, in the case of a plurality of motors, they can be controlled by a single controller or each motor may have its own controller. The system controller may be a single device or distributed between a plurality of computing devices In some embodiments, the fender is directed by a retention device, such as a wire ring or partial ring, and the wire ring or partial ring is adjustable via said hinge to direct the fenders position.

In some embodiments, the retraction system may be housed in an integrally-formed compartment in the boat.

In an aspect of an embodiment, the activation is after or inline with an operator prompt.

In an aspect of an embodiment, the application remembers a decision of the user.

In an aspect of an embodiment, the computing device is a smartphone, a navigation plotter, a GPS device, a tablet, an industrial computerized device, a device deigned to operate as boat controller or a device modified to work as boat controller, or an embedded computing system on the boat itself, on a boat fender system, or on any other equipment on the boat, and the computing device may be a single device or may be a network of devices.

In an aspect of an embodiment, wherein the system calculates boat fender deployment location based on information comprising boat location or map data.

In an aspect of an embodiment, the system adjusts boat fender deployment height based on the docking location.

In an aspect of an embodiment, actual boat fender deployment heights data for a specific docking event are stored on a server for use by other system users.

In another embodiment, the system further comprises a planning application that allows a plurality of future docking sites or areas to be specified by a user, and may allow the user to set a planned boat fender deployment height for each specified docking site and time.

In an aspect of an embodiment, the boat fender is raised or lowered to the correct level after, or regardless of, an operator acknowledgement based on cruising speed.

In an aspect of an embodiment, the controller is configured to detect failures to deploy or retract.

In an aspect of an embodiment, the detection of the failure to deploy or retract is based on changes in motor current, and operation of the system is changed based on the change in current.

In an aspect of an embodiment, upon the detection of a failure to deploy or retract, the system attempts to achieve a full deployment or retraction by reversals of line movement.

In an aspect of an embodiment, the system controller directs the motor to lower the boat fender to a specific deployed height.

In an aspect of an embodiment, the system updates the boat fender deployment height in response to a tidal information or by sensing height relative to the dock or water.

In an aspect of an embodiment, the boat fender is attached to a line attached to a winch coupled to a motor.

In an aspect of an embodiment, the winch is replaced by a pulley or a spool.

In another embodiment, the system further comprises a retention device for guiding, holding, or retaining a boat fender.

In an aspect of an embodiment, the line is connected to the fender by a spring or elastic component.

In an aspect of an embodiment, a lever is used to initiate, stop, or reverse the swinging out of the fender or the fender retrieval system.

In an aspect of an embodiment, an additional motor is used to assist the initiation, stopping, or reversing the swinging out of the fender or the system.

In an aspect of an embodiment, a safety release is added to the line, wherein if the force on the line is higher than a preset value, the safety release activates and disconnects the line.

According to another embodiment of the invention, a system with a retention device for stowing a boat fender, the retention device attached to a vessel, the retention device having an opening for threading through a line, the line being attached to the fender, the line operable to pull up the fender into the retention device through a second opening at the bottom of the retention device and where a moveable bar exists within the retention device across its opening directly above the fender, the bar having a small opening for guiding the line, which passes through it, the bar being moveable along the cylindrical axis of the retention device. In a variation of the embodiment, the bar is pulled up along with the fender into the retention device. Where the retention device has at least one moveable, hinged section, the section formed in such a manner that when the fender is pulled up into the top of the retention device, the movable section clamps in on the fender and secures it within the retention device.

In another embodiment, a cleat (or auto cleat) allows the line to be secured at any position, the cleat attached to or near the retention device, or at a convenient location some distance from the retention device, by passing the line through one or more guide rings or pulleys, and the fender is raised into the retention device upon leaving a dock and lowered to the correct level manually in preparation for docking of the boat.

In another embodiment, the fender is attached to the line, the line coupled to a winch, the winch coupled to a motor, and the motor controlled by a controller, wherein the controller is activated via wireline or wireless control signals. Here, the controller may be controlling more than one retention device. The winch may draw its power from a battery, where the battery is the onboard power supply or the battery is separate and recharged by a solar panel coupled to the battery. Each retention device may have its individual controller, battery and solar panel, as to not require any wiring between the units.

In some embodiments, the retention device may be mounted with at least one hinge to a stationary part of the boat within the boat's outline, the hinge operable to allow the retention device to swing out from the boat's outline, for easy deployment of the fender. Deployment of the retention device may be controlled for the swing-out with a lever, the lever attached to a second stationary part of the boat, the lever being used to initiate and stop or reverse the swing-out action. The lever may also be a hinged arm and may be operated manually or operated with an additional motor.

Alternately, the retention device may be mounted on at least one stationary part of the boat, substantially within the boat's outline, the retention device having an angle for enabling the fender to be lowered through an opening in the railing over the edge of the boat's board and have an additional slide extension at the bottom opening, the extension guiding the fender over the edge of the boat.

According to another embodiment of the invention, an application on a smart phone, the application having access to a map system and also optionally having access to a GPS system of the smartphone, wherein the application may be used by a user to add locations used by a vessel for landing, and the user may enter a mark representing a height of fenders to be deployed. The system may then remember the decision of the user whether or not and how to deploy the fenders, or whether no preset action is desired.

Finally, the enclosure may contain a camera looking outward from the boat, the camera supplied power by the same system that operates the fender, and the camera coupled to provide a video stream on request to one of the controlling computing devices, allowing a person to better see when approaching the docking location.

FIG. 1 (PRIOR ART) is an illustration of a typical pleasure boat 100, illustrating how fenders are normally hung on a boat's railings according to the prior art. Two fenders 107*a* and 107*b* hang down from the railing, positioned with lines 108*a-b* held in place with knots 109*a-b* on railing 102 to protect the boat hull 101 from damage when the boat makes contact with the dock. During a cruise, the fenders need to be lifted up and securely stowed, as otherwise the wave action could easily rip them off or cause them to damage the boat. Access to the railing for purposes of deploying and positioning fenders from the top of the boat may be difficult and hazardous (particularly in rough seas or inclement weather), because in many cases access is available only from a narrow ledge 106 via a step 110 or from the top of the boat prow 103 using window gate 105 in windshield 104, that window gate being heavy and difficult to open. Boat prow 103 is often of a slick material such as fiberglass coated, in some cases, with marine paint. Further, the surface may in many cases be wet with, in some cases, dust mixed in, and/or the boat may be rocking and jerking in wind and waves, making it even more slippery and more hazardous. From the railing a person must then lean over to deploy and position the fenders.

Figure 2:
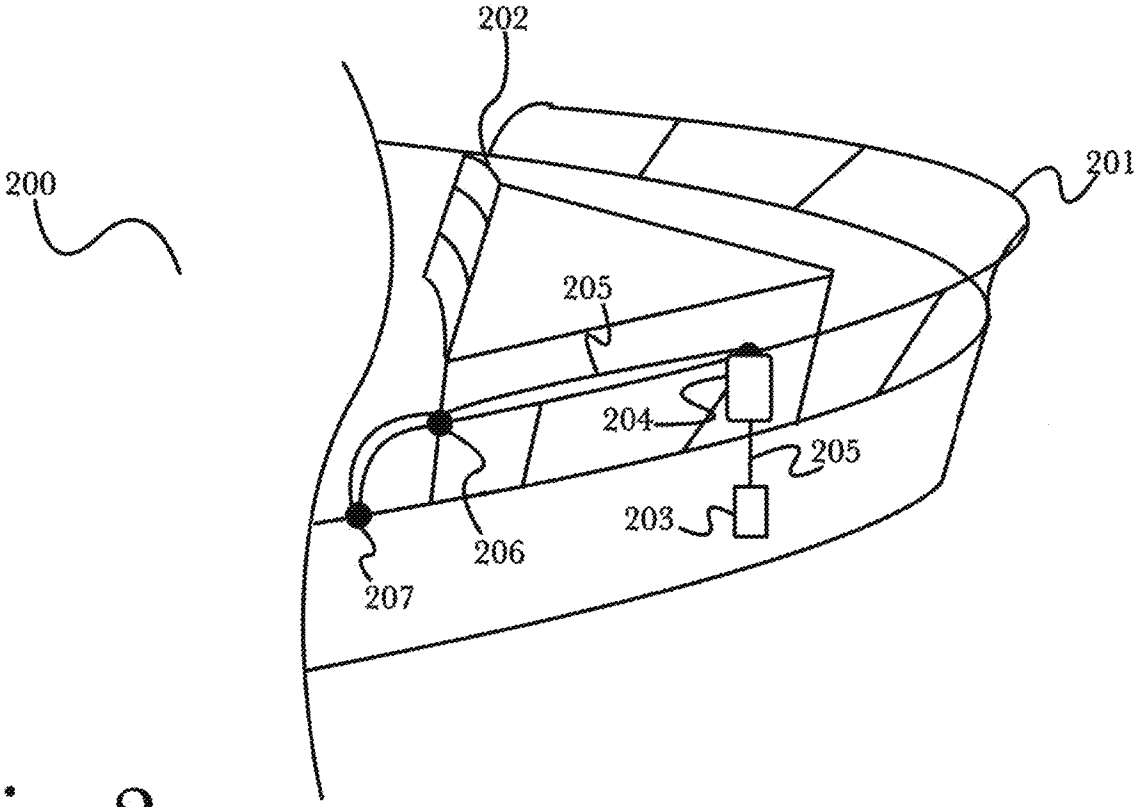
FIG. 2 shows an exemplary representation of an installation of manually-deployed boat fenders, according to a preferred embodiment of the invention.

FIG. 2 shows an exemplary representation of a system 200 of manually deployed boat fenders, with stowage retention devices 204, according to a preferred embodiment of the invention. Windshield 202 has a center partition that can be folded away to reach the boat prow. Attached to railing 201 is fender retention device 204, which holds fender 203 when the fender 203 is not in use (only one fender 203 and retention device 204 are shown, for purposes of clarity and simplicity; however, typically, multiple fenders are used). A rope, cable, or similar flexible line 205 (for purposes of this system, rope, cable, and line all shall be considered equivalent, irrespective of constituent material(s)), runs from a position above retention device 204, across pulley 206, to cleat 207, which cleat 207 is used by an operator to secure line 205 in position, which position is often predetermined and marked on line 205. Thus fender 203 may be hauled up into retention device 204 when the boat is undocked and taken out on the water, and fender 203 may be deployed (lowered) when the boat approaches a dock.

Figure 3:
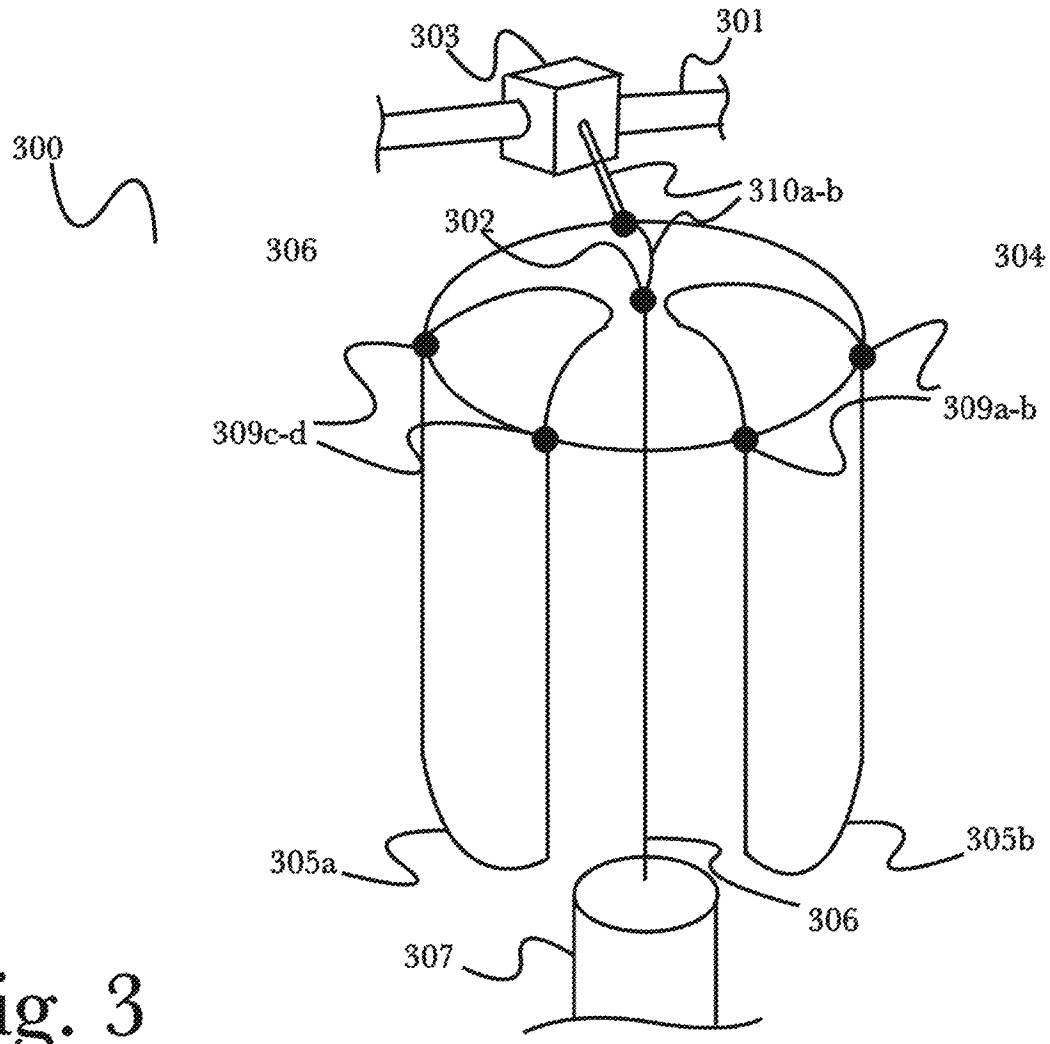
FIG. 3 shows an exemplary representation of a fender stowage retention device according to a preferred embodiment of the invention.

FIG. 3 shows an exemplary representation of a fender stowage retention device 300 as shown on FIG. 2 according to a preferred embodiment of the invention. Attached by clamp 303 to railing 301 is a holder 310*a* that holds ring 304, which in turn holds retention device 204, plus a pulley (or ring) 302, via holder 310*b*, the pulley 302 used to redirect line 306 when it comes up. In this example two sections (or segments) 305*a,b* are hinged at the top with, respectively, hinges 309*c,d* and 309*a,b*. Hinges 305*a,b* are attached to ring 304. When fender 307 is pulled up on line 306 across pulley 302, the tips of hooks 308*a,b* cause the extensions at the bottoms of sections 305*a,b* to clamp the fender 307 in place, as the hinge lever action causes the bottom ends of sections 305*a,b* to pull in. In some cases, retention device extension 305*a,b* may be made of plastic; in other cases, they may be made of some suitable material resistant to corrosion, such as, for example, chrome-plated wire. In yet other cases, the bottom end maybe be flaring (not depicted), allowing for an easier insertion of fender 307; in other cases it may be hooked inward (not depicted), providing additional securing of fender 307 when stowed. Also, in additional cases, rather than two sections, three, four or more sections maybe used. According to particular arrangements of a retention device 300, line 306 may be able exit from any point along a length of retention device 300, for example by passing through an open space between sections 305*a,b* to enable free movement.

Figure 4:
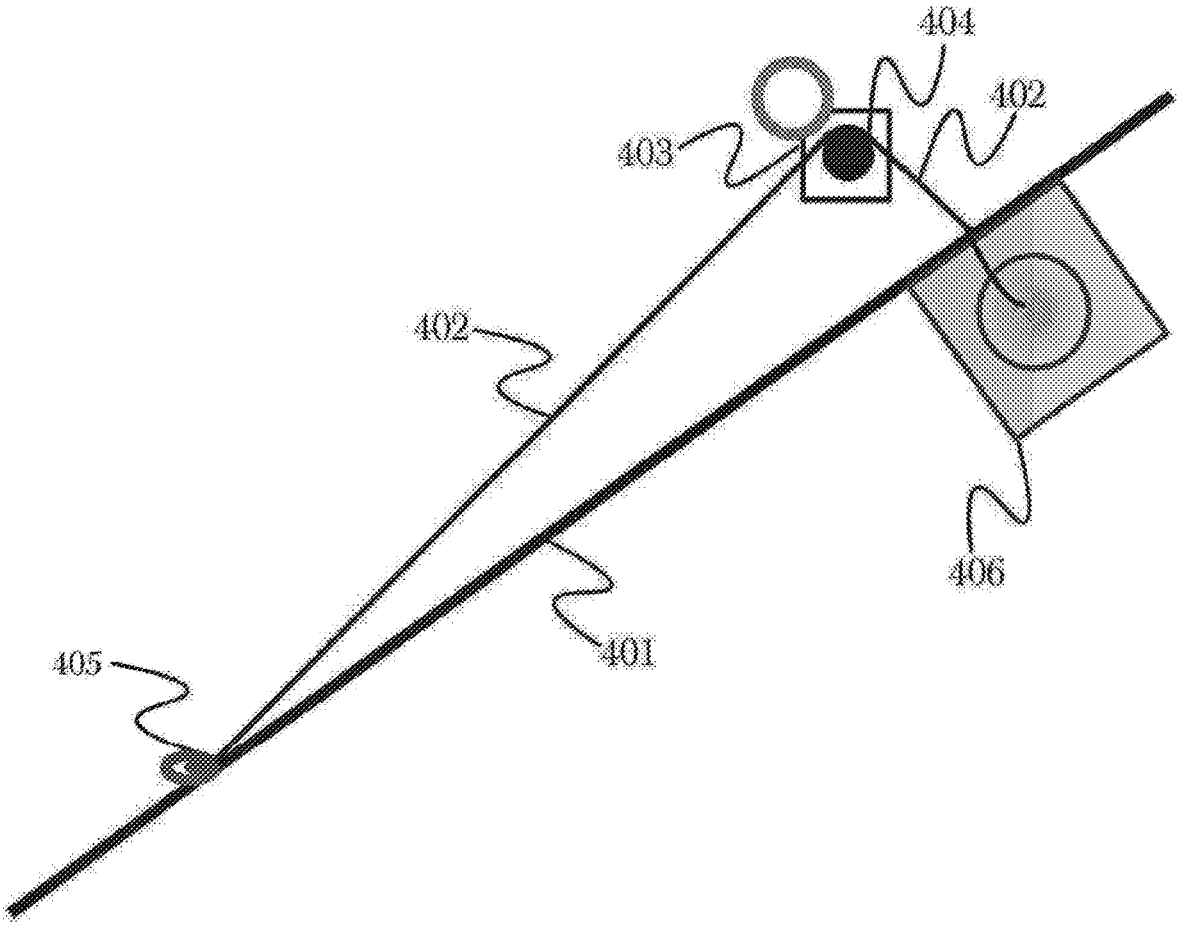
FIG. 4 shows an exemplary representation of a pulley and remote cleat mechanism for the safe and convenient stowage and deployment of boat fenders according to a preferred embodiment of the invention.

FIG. 4 shows an exemplary representation of a pulley and remote cleat mechanism 400 for the safe and convenient stowage and deployment of boat fenders according to a preferred embodiment of the invention. Line 402 comes in from the retention device 406 on railing 401 and goes through pulley wheel 404, which is attached to pulley block 403. At the pulley, line 402 is redirected to cleat 405. In some cases, double or triple pulleys maybe used as often more than one fender is used. Also, instead of regular cleats, fast cleats and multi-line fast cleats maybe used for easier use.

Figure 5:
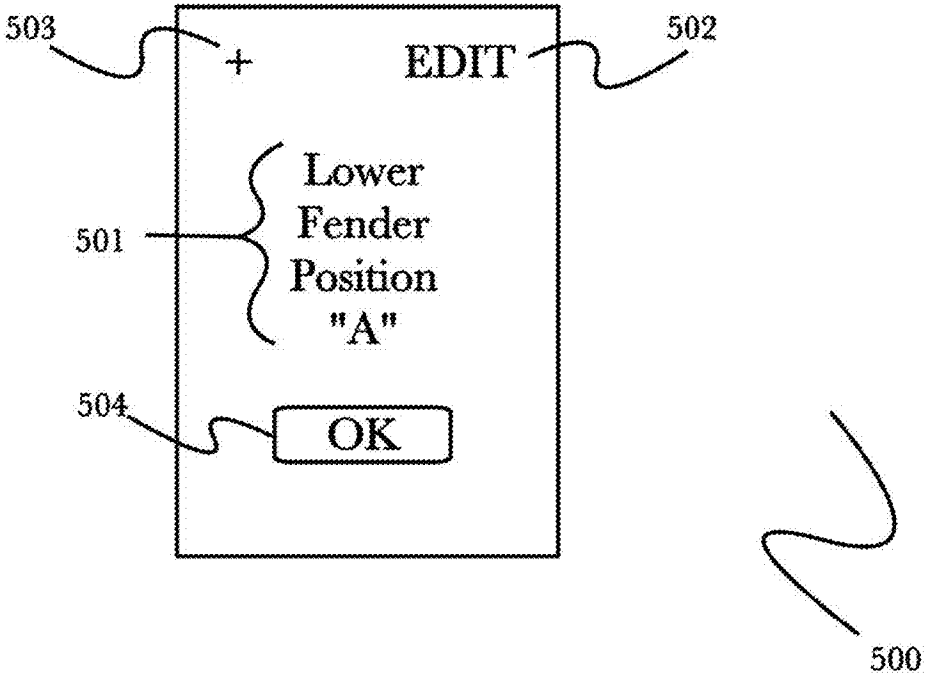
FIG. 5 shows an exemplary representation of a user reminder app for boat fender deployment according to a preferred embodiment of the invention.

FIG. 5 shows an exemplary representation of a user reminder application 500 for boat fender deployment according to a preferred embodiment of the invention. It uses high-accuracy marine maps such as, for example, NAVIONICS™, to determine whether the boat is about to dock, and notifies the user with message 501 (and in some cases an acoustic alert) of the position to which the lines need to be lowered. Also shown are buttons to add new positions "+" 503 based on current GPS location, to set the height, and to "edit" 502 for modifying an existing height, for example, or delete a previously stored location. Further, an OK button 504 enables the operator to confirm and/or close the alert and mute an acoustic signal.

Figure 6:
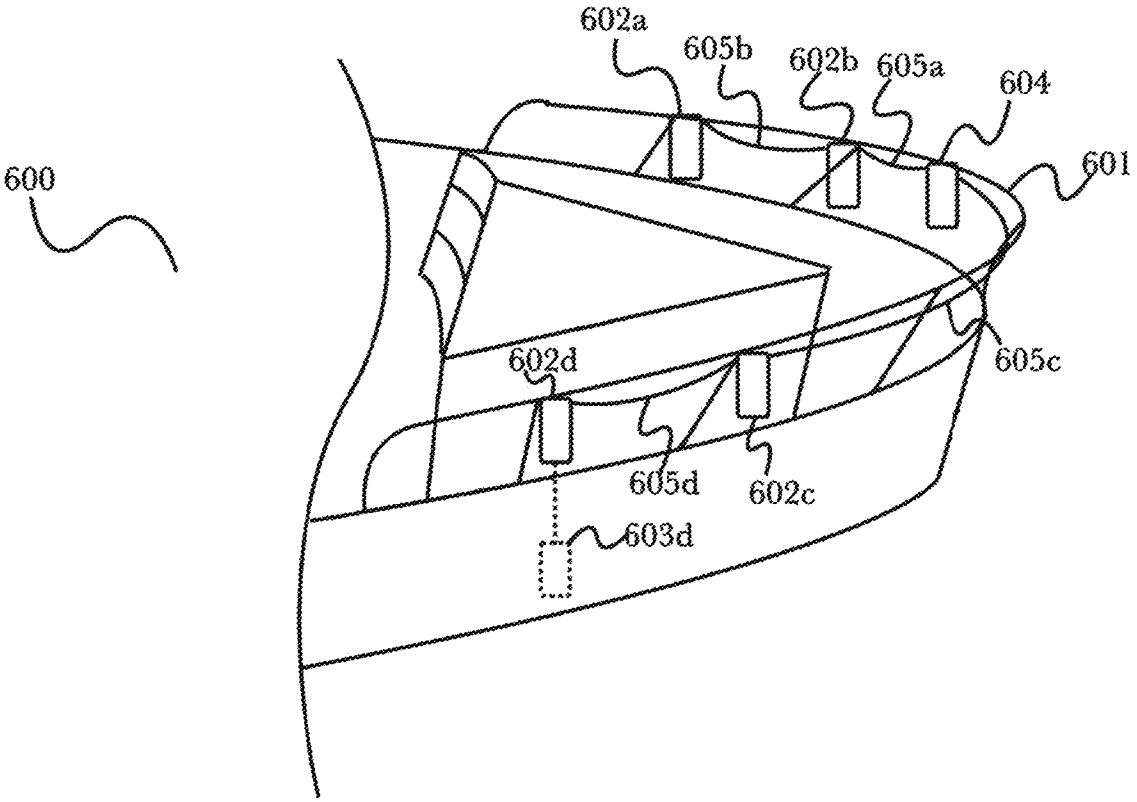
FIG. 6 shows an exemplary representation of the connection of four retention device and fender mechanisms connected by wires to a solar panel according to a preferred embodiment of the invention.

FIG. 6 shows an exemplary representation of a system 600 where the connection of four retention device and fender mechanisms connected by wires to a solar panel 604 according to a preferred embodiment of the invention. Four retention devices 602*a-d* are attached to railing 601. Wires 605*a-d* connect the retention devices to solar panel 604, which is also attached to railing 601. Beneath solar panel 604, and connected to it, are a controller and a battery (not shown here). Fender 603*d* (only one fender shown here, for clarity and simplicity) is shown as it may be deployed, with multiple dotted lines to indicate that the fender may be deployed at any of multiple heights. It is clear that a boat may carry more than four retention device-fender units, and they are typically deployed all along an engaged side of the boat, from prow to stern; however, for clarity and simplicity, only four are shown as positioned here.

Figure 7:
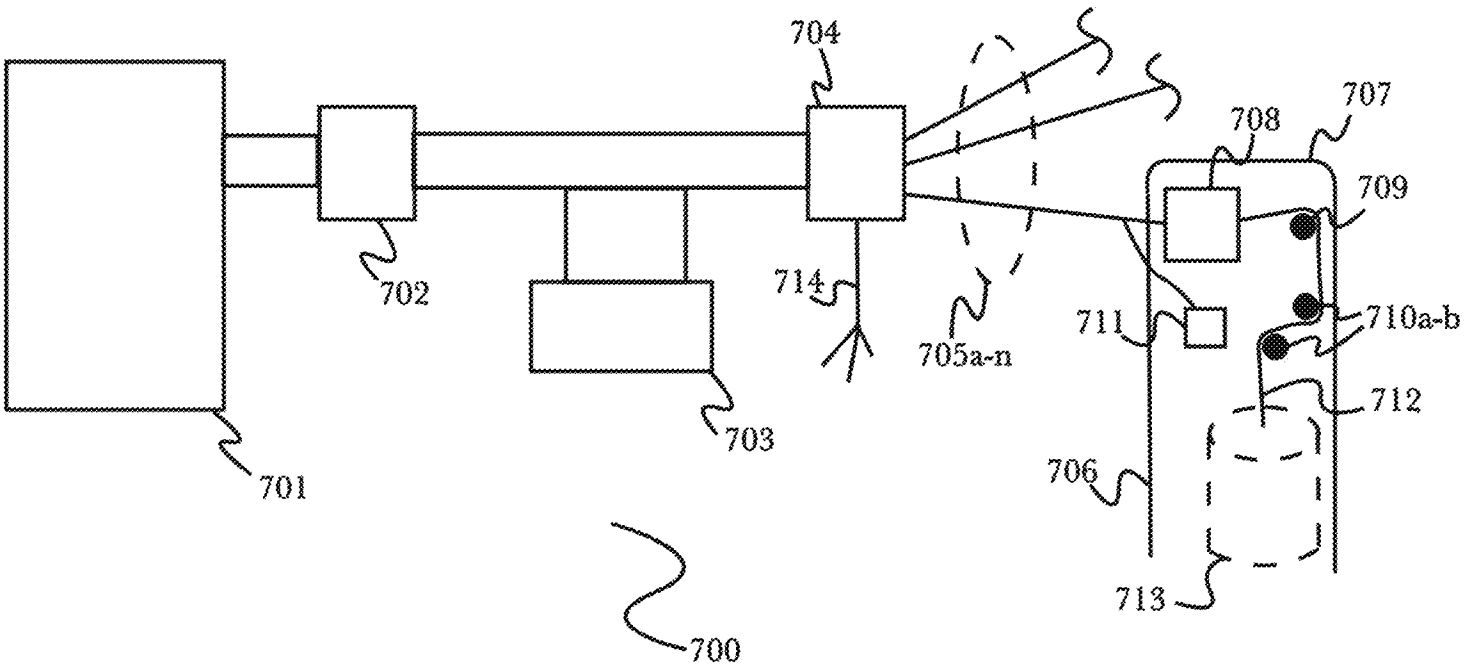
FIG. 7 is a diagram of an exemplary solar panel assembly connected to a retention device and fender mechanism according to a preferred embodiment of the invention.

FIG. 7 is a diagram of a system 700 with a solar panel assembly connected to a retention device and fender mechanism (as shown in 604) according to a preferred embodiment of the invention. Panel 701 connects to charge control unit 702. Unit 702 may be an existing commercial product that is readily available or a specific design for the motorized fender system. In some cases unit 702 may be integrated into a junction box at the rear of panel 701. Battery 703 may be any of various types of battery known in the art, such as, for example, lead-acid, lead-acid gel, lithium, lithium ion, LiFePO4, NiCd, NiMh, or any other suitable type, depending on which is best and most suitable for its situation. System controller 704 has an antenna 714 and wires 705*a-n* leading to the retention devices. Exemplary retention device 706, connected to box 704 via wire 705*x*, contains fender 713, shown in a dotted line to indicate that it is not externally visible. Line 712 goes over two pulleys 710*a, b* to winch 709 that is attached to motor 708. Casing 707 protects assembly elements, including 707, 709, 710*a,b*, 711, and 712 against water, collision, injury of persons nearby, etc. When fender 713 is retracted, switch 711 signals to controller 704 when the fender is fully retracted. In some cases, a smaller solar cell and smaller controller may be mounted on the top of the retention device, omitting the need for wires such as wire 705*x*. Typically wire 705*x* uses a four-lead wire, that is, two for the motor and two for the switch. In other cases, instead of using a solar panel to power the system, controller 704 may be powered from the boat's power supply. In yet other cases, the assembly contained in case 707 may be installed centrally and the line may be pulled as shown in FIG. 2 to a location with multiple motorized winches. Also, in lieu of using a mechanical switch 711, optical means, both transmissive and reflective, may be used, or simply a change in current of the motor that the controller can detect and use as an indicator of too much resistance, either at the end or if fender is caught somehow. All these exemplary variations, and other, similar variations, shall not depart from the spirit of the system and method disclosed herein.

Figure 8:
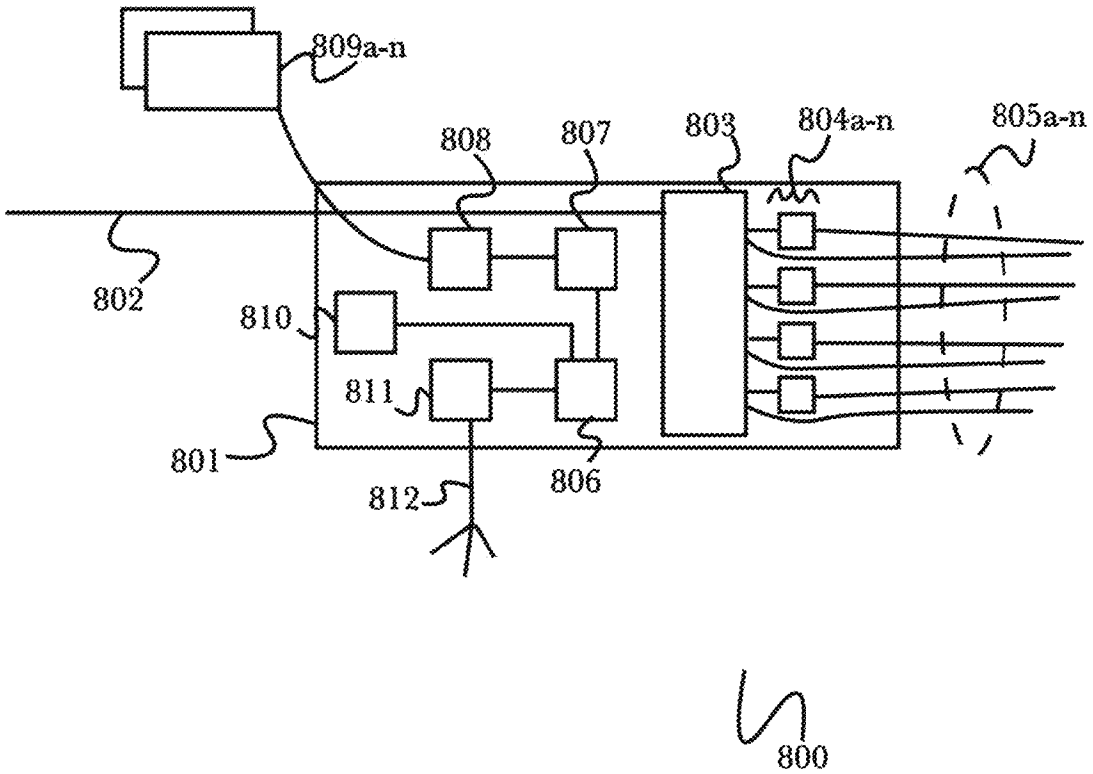
FIG. 8 is a diagram of an exemplary controller for the deployment and retraction of fenders according to a preferred embodiment of the invention.

FIG. 8 is a diagram of an exemplary controller for the deployment and retraction of fenders 800, also shown in 704, according to a preferred embodiment of the invention. Power supply input 802 may come from a local battery, a shipboard battery, or some other power source. Controller 801 has a microprocessor 806, typically a system on a chip with memory 807 and nonvolatile memory 808, which nonvolatile memory contains software 809*a-n*, including an operating system as well as actual commands for the system. Input/output unit 810 may pair the radio 811 with a smart phone. Radio 811 connects to microcontroller 806 as well as to antenna 812. The connection between radio 811 and a smart phone may be via, for example, Bluetooth, Wi-Fi, or both, as needed. Power switch unit 803 distributes power to all these devices, as well as controlling output power through switches 804*a-n*, thus enabling the winches to extend lines 805*a-n* to extend or retract the fenders. Switch unit 803 also has the input sensors for the switches in the retention devices, such as, for example, switch 711 inside casing 707, described above in the discussion of FIG. 7, for extending or retracting the fenders.

Figure 9:
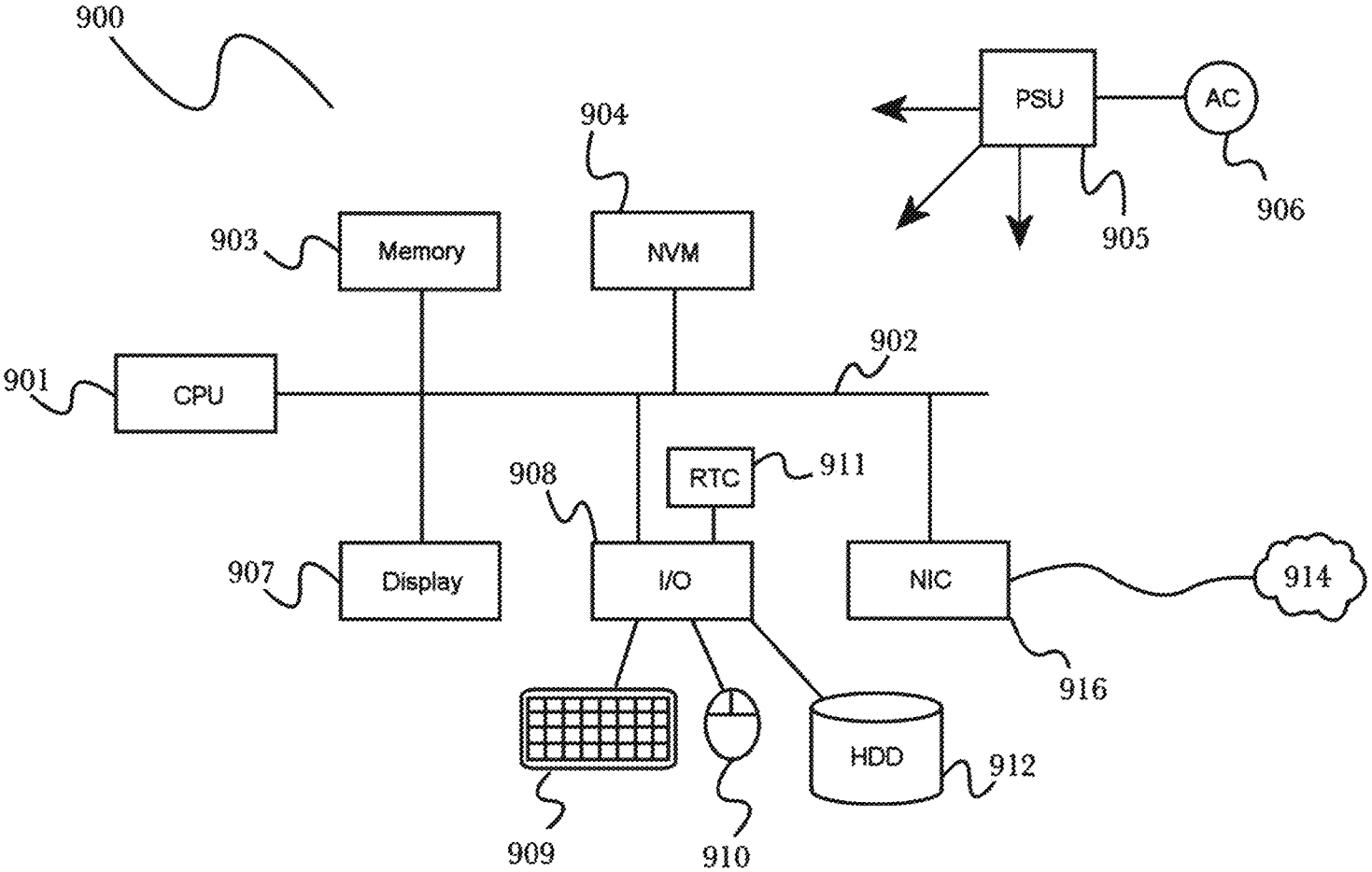
FIG. 9 is an exemplary diagram of a computer system as may be used in the system and methods disclosed herein.

FIG. 9 is an exemplary diagram of a computer system 900 as may be used in the system and methods disclosed herein, according to various embodiments of the invention. It is exemplary of any computer that may execute code to process data. Various modifications and changes may be made to computer system 900 without departing from the broader spirit and scope of the system and method disclosed herein. CPU 901 is connected to bus 902, to which bus is also connected memory 903, nonvolatile memory 904, display 907, I/O unit 908, and network interface card (NIC) 916. I/O unit 908 may, typically, be connected to keyboard 909, pointing device 910, hard disk 912, and real-time clock 911. NIC 916 connects to network 914, which may be the Internet or a local network, which local network may or may not have connections to the Internet. Also shown as part of system 900 is power supply unit 905 connected, in this example, to ac supply 906. Not shown are batteries that could be present, and many other devices and modifications that are well known but are not applicable to the specific novel functions of the current system and method disclosed herein. Also present, but not shown in detail, as part of I/O unit 908, for example, will local wireless connections, such as Bluetooth, Wi-Fi, ZigBee etc. Further, in many cases, a GPS receiver is used to provide for location services.

Figure 10:
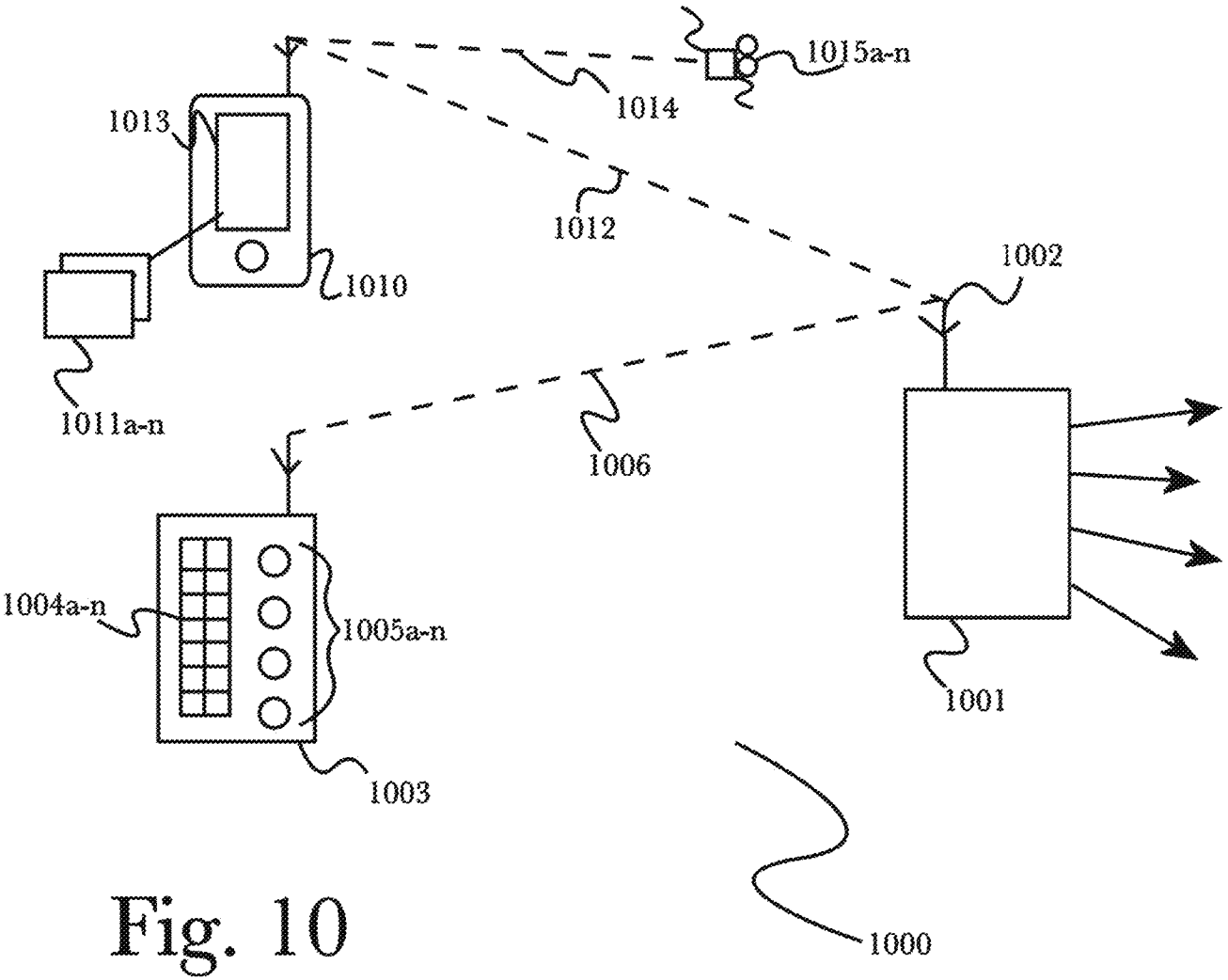
FIG. 10 is an exemplary diagram of a wireless control system for deployment and retraction of boat fenders as per a preferred embodiment of the invention.

FIG. 10 is an exemplary diagram of a wireless control system 1000 for deployment and retraction of boat fenders, according to a preferred embodiment of the invention. Controller 1001, which is functionally equivalent to controller 704, described above in the discussion of FIG. 7, has an antenna 1002 and also the software and other components required to control fender deployment operations as previously described. Controller 1001 may connect to a dedicated control unit 1003, which unit may have a set of buttons 1004*a-n*, such as, for example, two rows of buttons 1004*a-n* as shown here. Each button has a separate assigned function, such as controlling the raising or lowering of one or more fenders. General controls 1005*a-n* may, for example, indicate the status of certain system functions, such as, for example, power state and the state of connectivity to wireless network 1006, which network may use Bluetooth, Wi-Fi, or some other similar connection protocol. Controls 1005*a-n* may also control functions such as raising or lowering all fenders or certain combinations of fenders, such as all fenders on one side, for example. As an alternative control unit, system 1000 may use a smart phone, such as, for example, phone 1010, on whose touch screen 1013 the user can control the functions of specialized software 1011*a-n*. Software 1011*a-n* is specific to system 1000 and typically may be downloaded from an app store supplying software for the particular model of phone 1010. Software 1011*a-n* can communicate with controller 1001 via connection 1012, which may be Bluetooth, Wi-Fi, or some other similar connection protocol. Connection 1014 enables phone 1010 to communicate with geo-positioning satellites 1015*a-n*, using any of various global positioning systems (GPS) supported by phone 1010 and available currently or in the future.

Figure 11:
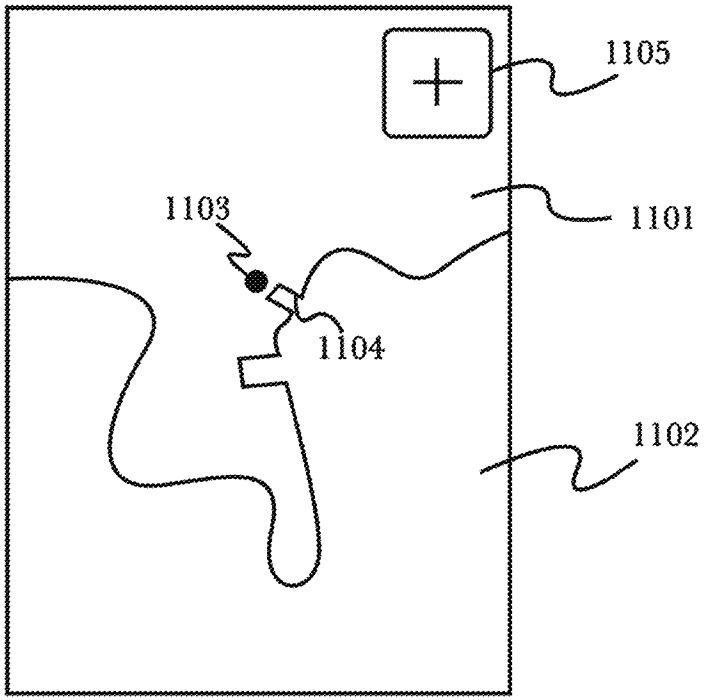
FIG. 11 shows a representation of an exemplary system application screen depicting a boat approaching a dock in a harbor, according to a preferred embodiment of the invention.

FIG. 11 shows a representation of an exemplary system application screen 1100 depicting a boat approaching a dock in a harbor according to a preferred embodiment of the invention. In this example, a boat 1103 is in water 1101, approaching dock 1104, which dock extends from land 1102. When boat 1103 comes within a certain predetermined distance from dock 1104, an indicator 1105 appears on application screen 1100. The boat's position, in this example, is determined by high-accuracy navigational mapping software (not shown here) as mentioned in the description of FIG. 5. Indicator 1105 enables a user to open addition application menus with additional functionality.

Figure 12:
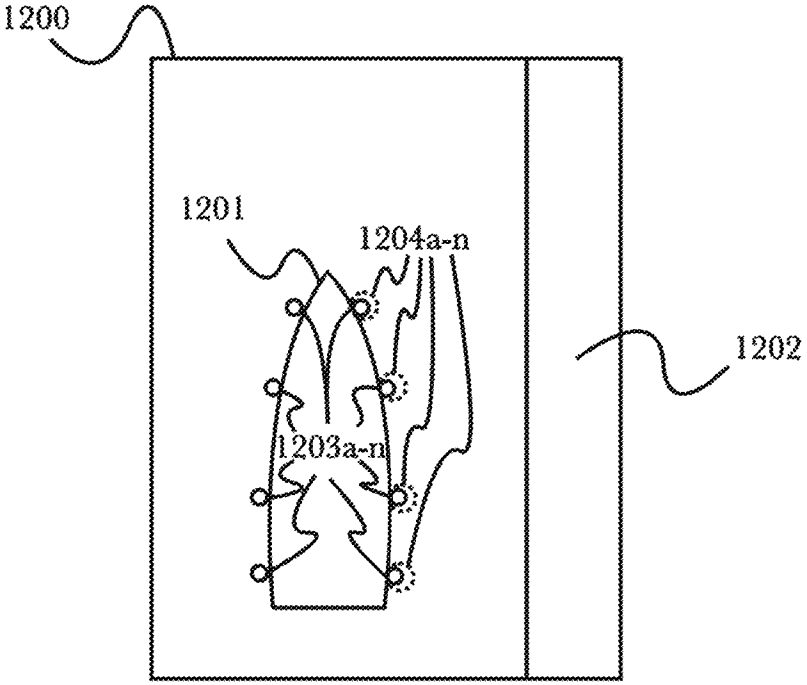
FIG. 12 shows an application screen that is exemplary of additional application functionality according to a preferred embodiment of the invention.

FIG. 12 shows an application screen 1200, accessed using indicator 1105 that is exemplary of additional application functionality according to a preferred embodiment of the invention. In this example, boat 1201, viewed from the top, approaches dock 1202. Screen 1200 shows all boat fenders 1203*a-n*, of which in this example there are eight. Those fenders on the side 1204*a-n* approaching dock 1202 may be indicated, for example, by halo buttons, that is, buttons showing a halo around the fender indicating a possible user interaction. Screen 1200 may also contain an additional button (not shown here) that enables a user to control multiple fenders, such as, for example, all fenders together, all fenders on the side of the boat approaching the dock, all front fenders, all rear fenders, etc.

Figure 13:
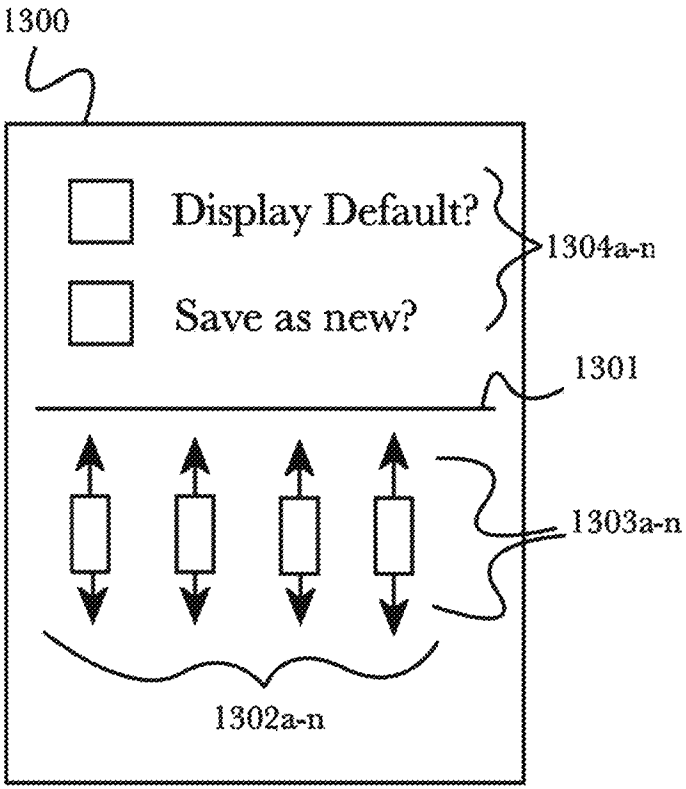
FIG. 13 shows an exemplary application screen that may open when a user has deployed boat fenders according to a preferred embodiment of the invention.

FIG. 13 shows an exemplary application screen 1300 that may open when a user has deployed boat fenders as described in the discussion of FIG. 12, according to a preferred embodiment of the invention. Represented on screen 1300 is one side 1301 of the boat, with fenders 1302*a-n*. Above and below fenders 1302*a-n* are arrows 1303*a-n*, indicating fender movement up or down. Buttons 1304*a-n* give a user control of general functions, such as, for example, deploying all fenders to a default position or saving a manually controlled position as a new default position. Individual fender positions may be manually controlled by pressing any of arrows 1303*a-n* to adjust any one fender up or down as desired. When the fenders are all adjusted for a certain dock, the user could then save the fender positioning as a new default for this location, so the next time the user goes to approach this particular dock, the fenders can be deployed automatically to the saved positions when the boat comes within a certain predetermined distance from the dock.

Figure 14:
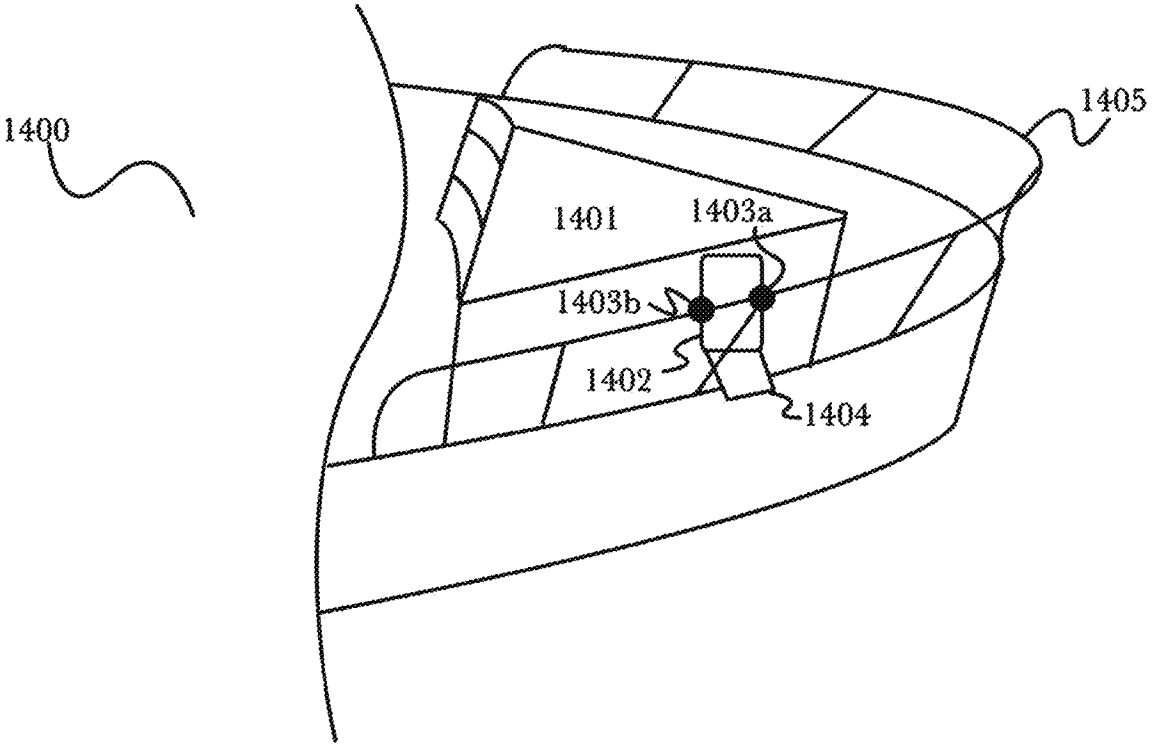
FIG. 14 shows an exemplary representation of a boat prow where the retention device is mounted on one or more hinges according to a preferred embodiment of the invention.

FIG. 14 shows an exemplary representation of a boat prow 1400 where a retention device 1402 is mounted on one or more hinges 1403*a-b*, according to a preferred embodiment of the invention. This figure shows many structures found at the prow of the boat, including railing 1405, prow 1401 with cabin windows, and other features. Exemplary retention device 1402 is, in this example, mounted behind railing 1405, with mounting hinges 1403*a-b* on the inside of railing 1405. Chute 1404 is attached to retention device 1402, so the fender within retention device 1402 may slide down against the boat side. Deploying and retracting the fender may be done manually, with, for example, a line, or by a motor. In some cases, chute 1404 may have a small lip, so the fender can easily be retracted back up into retention device 1402. In other cases, chute 1404 may be recessed behind the farthest extension of the outward vertical curve of prow 1400, thus not protruding into the line of travel (up and down) of the fender.

Figure 15:
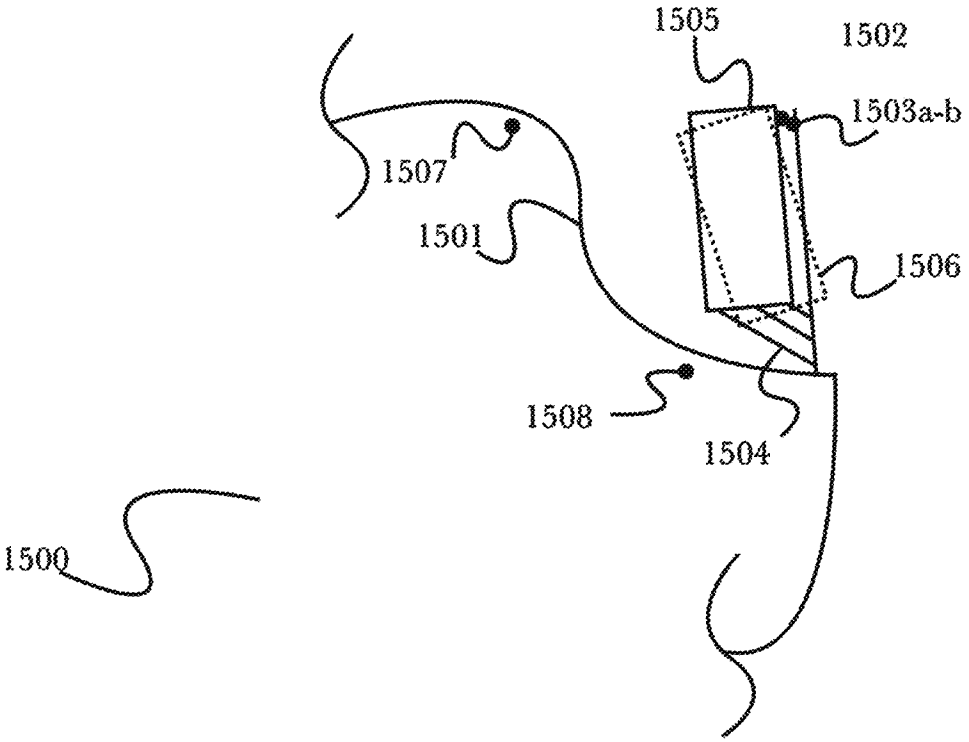
FIG. 15 shows an exemplary cross section of a boat with a representative retention device secured by mounting hinges and a chute that aids in deployment according to a preferred embodiment of the invention.

FIG. 15 shows an exemplary cross section 1500 of a boat 1501 with a representative retention device secured by mounting hinges and a chute that aids in deployment, according to a preferred embodiment of the invention. The outlines of boat 1501, prow section 1507 on top, walkway 1508 behind the railing, and the hull are all, for reasons of clarity and simplicity, very simplified. Retention device 1502, secured by mounting hinges 1503*a, b*, and chute 1504 are slightly behind the outermost part of the hull of boat 1501, because fender 1505 is heavy enough to slip over the edge of boat 1501 when it is deployed. Deploying and retracting fender 1505 may be done manually, with, for example, a line, or by a motor. On the other hand, when fender 1505 is retracted, because there is no edge of chute 1504 protruding beyond the hull, fender 1505 can easily slip back up chute 1504 and into retention device 1502. Outline 1506 shows an alternative retention device 1502 position, wherein retention device 1502 may be hinged around the railing so that during deployment and retraction of fender 1505, the retention device bottom tilts slightly outward.

Figure 16:
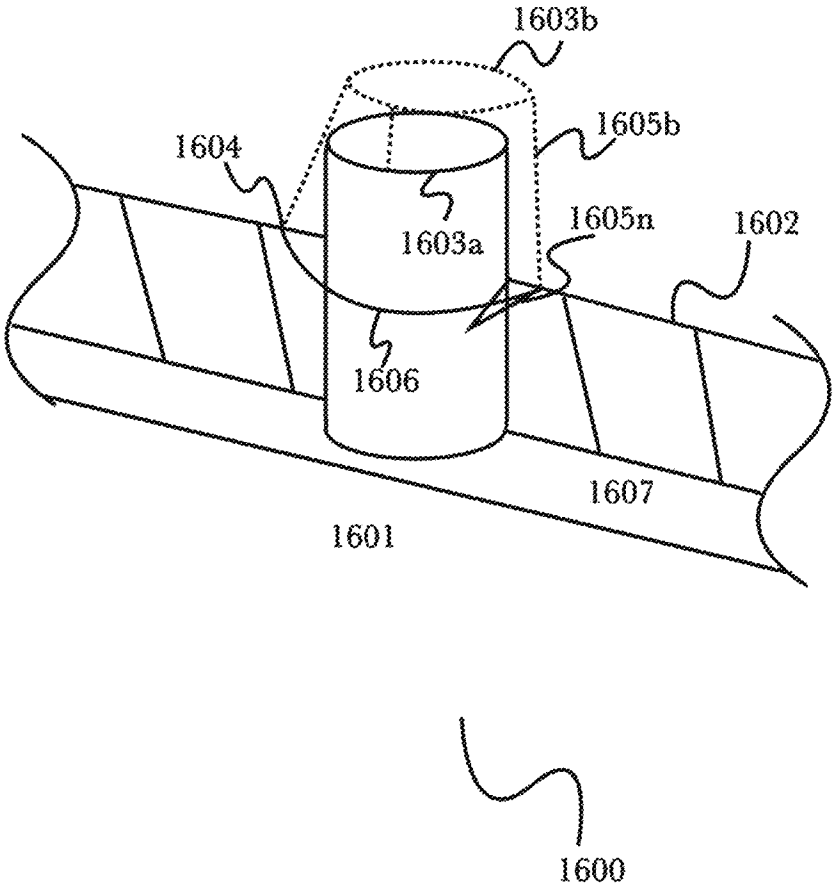
FIG. 16 shows a diagram of an alternative method to recess the retention device according to a preferred embodiment of the invention.

FIG. 16 shows a diagram of an alternative arrangement 1600 by which retention device 1603*a* may be recessed, according to a preferred embodiment of the invention. Shown are walkway 1607, behind railing 1602, and prow 1601. Railing 1602 has a notch or bay 1606 in the inner edge so fender retention device 1603*a-b* can retract in large part behind the outline of the railing. In this example, hinge 1604 enables retention device 1603*a-b* in position 1603*a* to swing out into position 1603*b*. Arm 1605*n*, shown in position 1605*n* retracted and in position 1605*b* extended, may be operated manually, with, for example, a lever or knob, a line, a spring or by a motor, and the like. Deploying and retracting the fender (not shown here) may also be done manually, with, for example, a line, or by a motor, as described earlier herein. Arm 1605*n*, in extended position 1605*b*, pushes retention device 1603*a-b* into position 1603*b*, so the fender can deploy vertically without hitting the deck or railing. In some cases, such a bay or notch 1606 may be flanked by one or two posts, enabling additional hinges to further control the swing of retention device 1603*a-b* (not shown). Once the fender is deployed, arm 1605 may retract retention device 1603*a-b* to a position behind the boat's outline.

Figure 17:
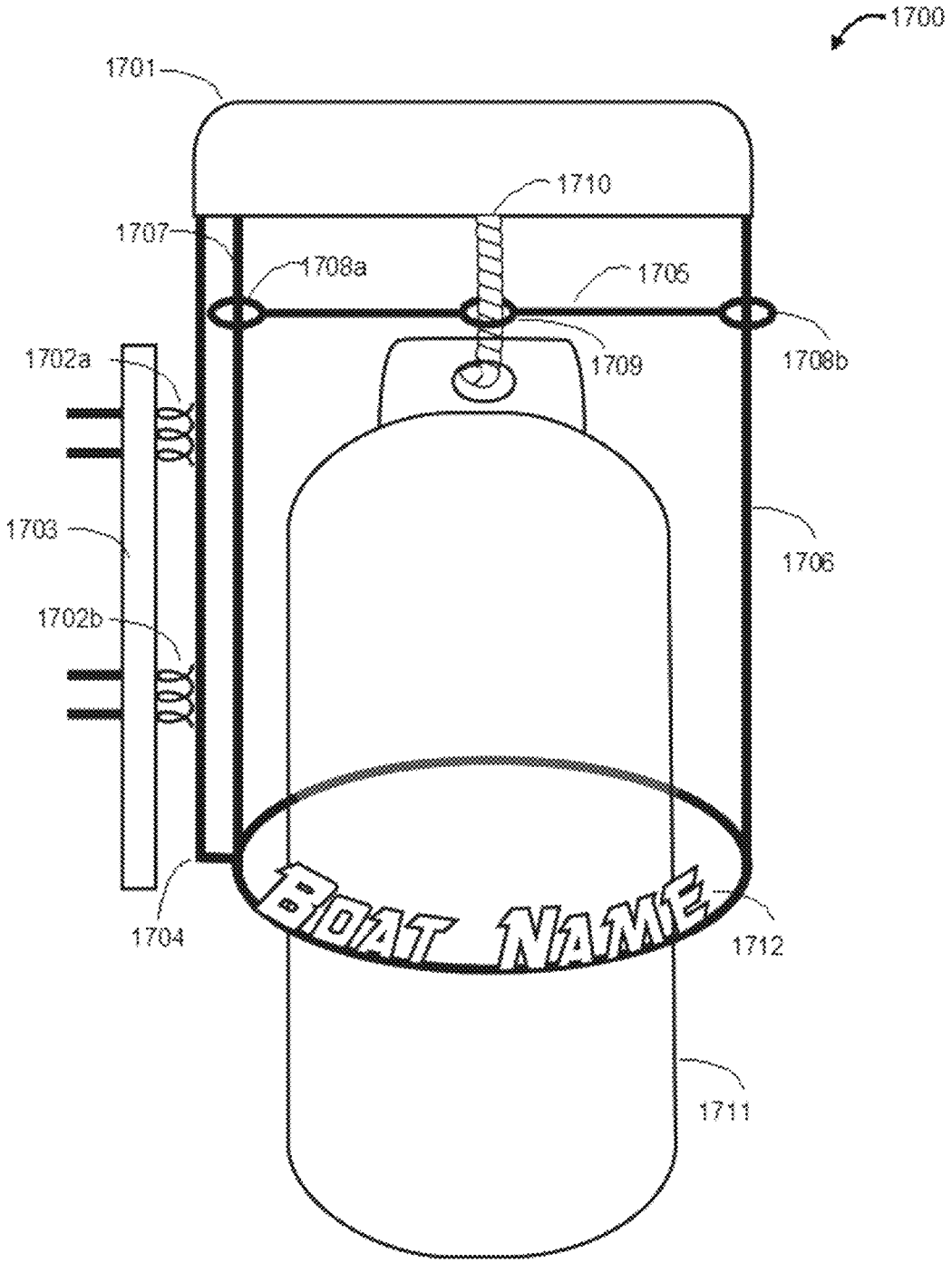
FIG. 17 shows an exemplary representation of an enhanced boat fender retention device according to a preferred embodiment of the invention.

FIG. 17 shows an exemplary representation of an enhanced arrangement 1700 of boat fender retention device 1701 according to a preferred embodiment of the invention. Retention device 1701 has a mechanism for winding up line 1710 to retract fender 1711. The hinge allowing retention device 1701 to swing in behind the hull line is comprised of springs 1702*a* and 1702*b*. These springs move retention device 1701 outside the hull line for normal operations. Although this example shows two springs 1702*a-b*, it is clear that other arrangements may have more or fewer springs 1702*a-b*. These springs (1702*a-n*) hinge between bar 1703, which attaches typically to a vertical railing post or other suitable fixed object(s) on the boat, and retention device rail 1704 (part of the retention device structure 1700). Moveable bar 1705 has three openings. These openings 1708*a* and 1708*b* are at each end, for riding up and down retention device bars 1707 and 1706, as well as one opening 1709, which is roughly in the center, for guiding line 1710 to which fender 1711 is attached. In the fully extended position, moveable bar 1705 is stopped at the bottom end of the retention device, across the retention device opening. As the fender 1711 is retracted, it catches moveable bar 1705 when it reaches opening 1709 and pushes bar 1705 up as fender 1711 is fully retracted, bar 1705 being moveable along the cylindrical axis of retention device 1701. Optionally the boat name 1712, in alphanumeric characters, may be applied in desired color(s) and finishes. In some cases retention device 1701 may contain a camera (not shown) that provides a close-up view of the pier to the controlling tablet and or smartphone, helping to "fine-maneuver" the boat into the desired docking position.

Figure 18:
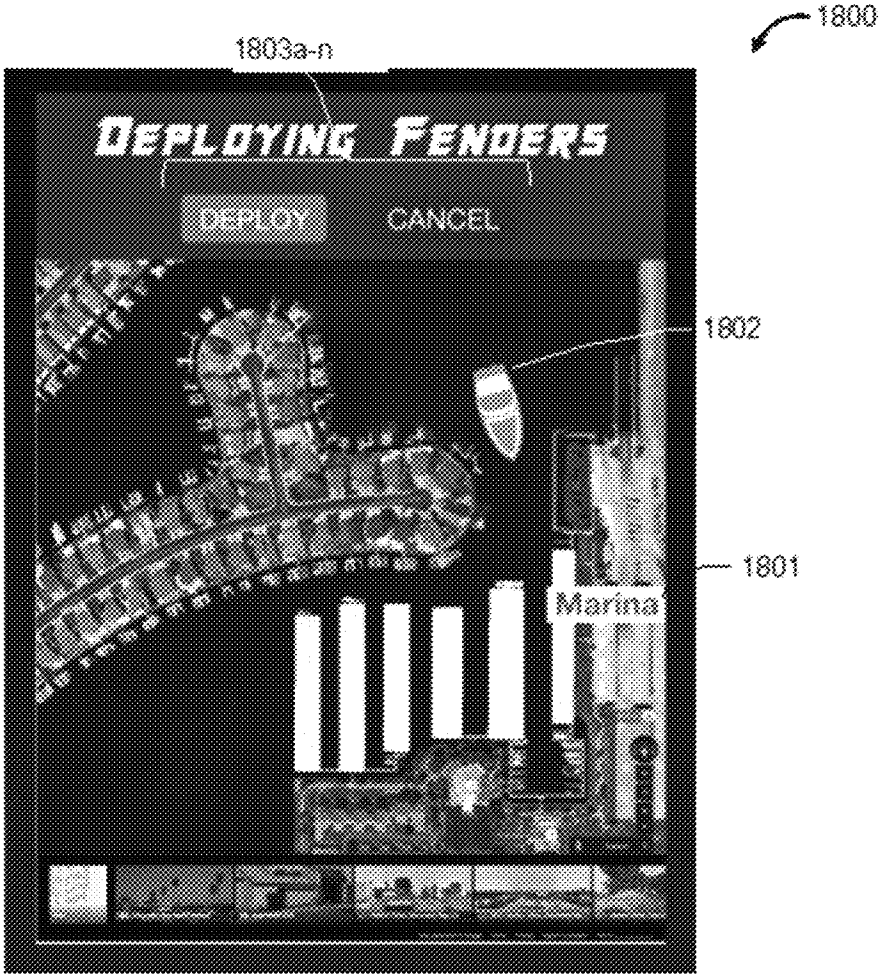
FIG. 18 shows an exemplary fender deployment reminder pop-up screen according to a preferred embodiment of the invention.

FIG. 18 shows an exemplary fender deployment reminder pop-up screen 1800 according to a preferred embodiment of the invention. When approaching a marked location, such as a previously visited landing place. In this example as boat 1802 enters marina 1801, the question of whether to deploy or not, if no prior default was set, appears at the top of screen 1800. The user can then issue the command by clicking either one of the response buttons 1803*a-n*. Although this example shows two buttons 1803*a-n*, there could be more, such as, for example, more than one deploy button, one for the standard height, and one or more for other options.

Figure 19:
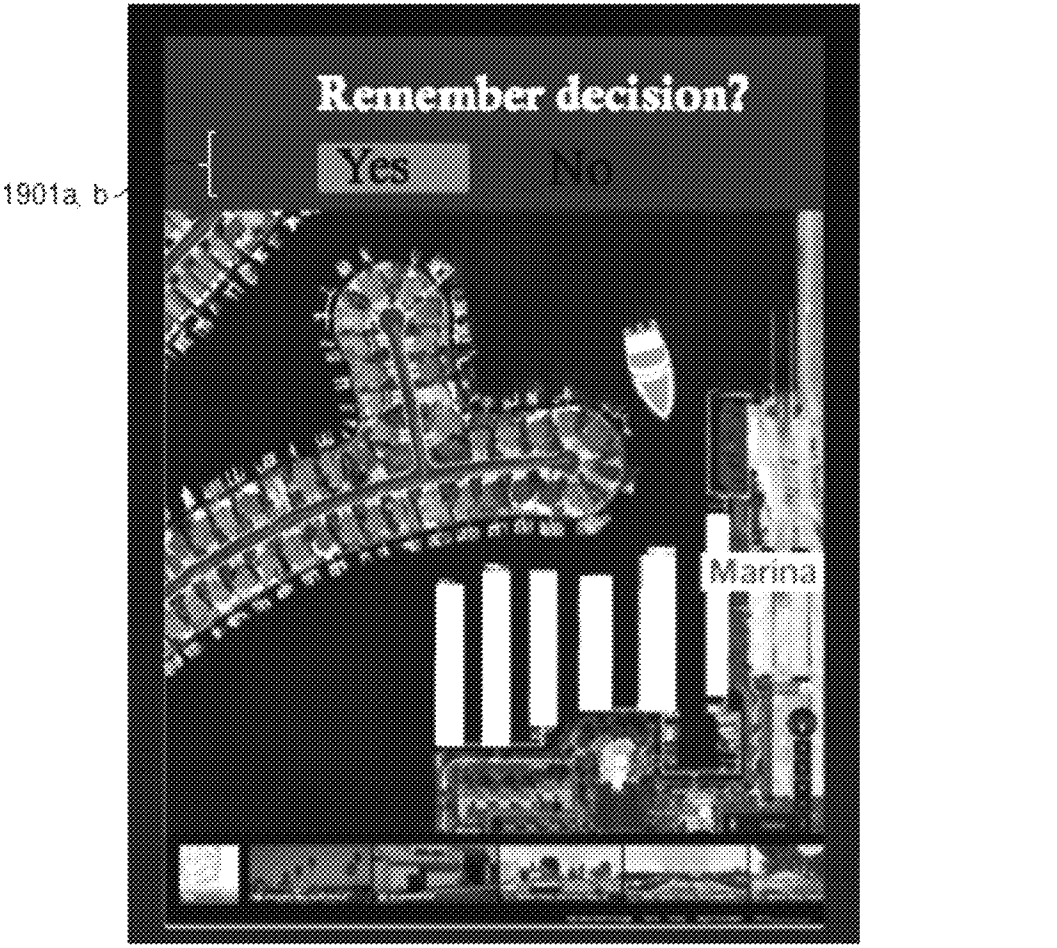
FIG. 19 shows a screenshot in which the system prompts the user whether to remember the decision.

FIG. 19 shows a screenshot 1900 in which the system prompts the user whether to remember a decision regarding fender deployment. Specifically, the system prompts the user whether to remember the decision from screen 1800 for the next time the vessel approaches the same location, by selecting either one of the response buttons 1901*a,b*.

Figure 20:
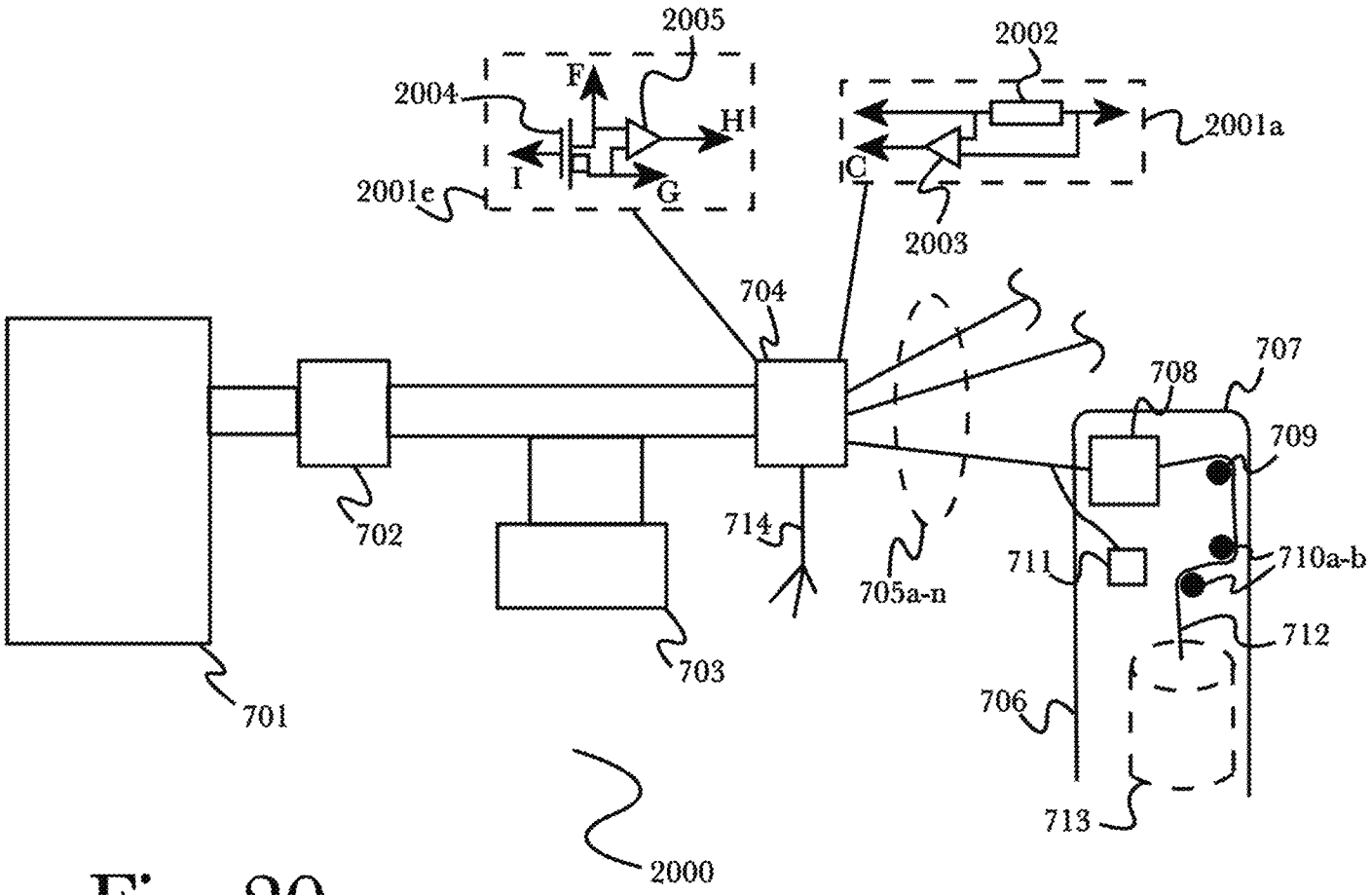
FIG. 20 shows an exemplary representation of two alternative methods for protecting a boat motor and electronic circuitry from overload due to problems with raising a boat fender.

FIG. 20 shows a modified version 2000 of FIG. 7, according to one aspect of the system and method described herein. Added to controller 704 are two optional extensions. In configuration 2001*a* measuring resistor 2002 has been inserted in series with motor 708. Sensing amplifier 2003 delivers a sensing voltage to point C. Once a certain current has been exceeded, the sensing voltage triggers a motor shut-off by notifying the shutoff circuitry in the controller, typically in a way similar to the way shutoff switch 711 is notified. This approach can sense if the motor is over-loaded and can protect the batteries, the motor, and the driving transistors or relays. It can also be used to shut off the motor in the case of an entanglement, such as, for example, a tangle in the line or rope that pulls up the fender, or if the fender is somehow tangled below the retention device and cannot be pulled up. Of course, it will be appreciated by one having ordinary skill in the art that other problems may occur that prevent a fender from being fully retracted; for example, due to boat motion caused by water waves, a fender may fail to properly enter the retention device because of misalignment or rotation of the fender. Thus this approach can protect the line from being torn and the fender lost at sea. Alternative configuration 2001*e*, shows, instead of an added resistor 2002, that the switching transistor 2004 driving motor 708 between contact points F and G is used as the measuring resistor, and the amplifier 2005 drives the voltage H. Also, point I drives the transistor. Both configurations 2001*a* and 2001*e* are commonly used approaches to measuring currents or protecting motors and/or other circuitry elements from overload and are not novel in and of themselves. However, the use of motor overloads to detect entanglement with respect to the fender, and in particular to aid with untangling, is novel.

Figure 21:
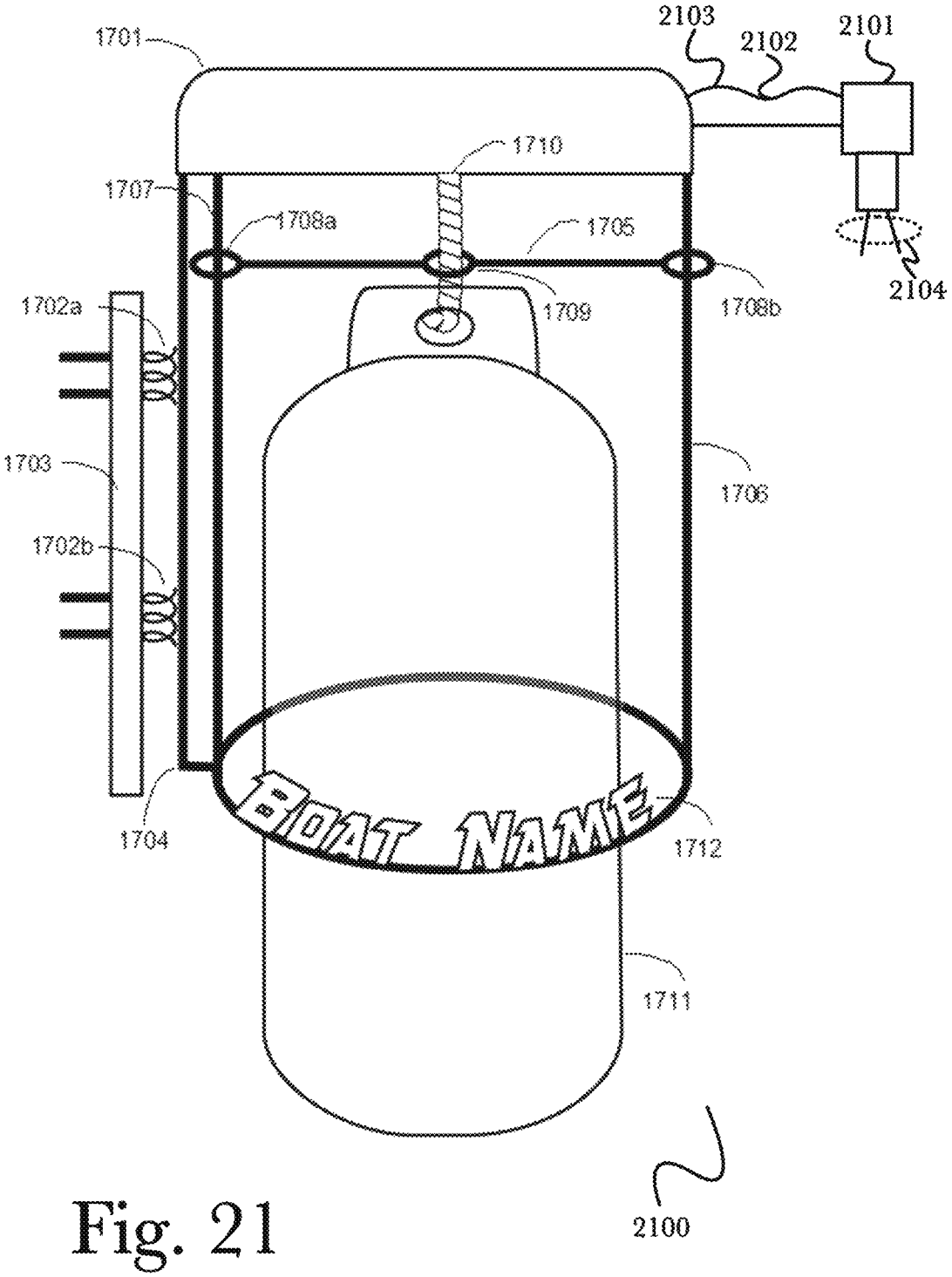
FIG. 21 shows an exemplary representation of an approach for viewing entanglements or other problems preventing a boat fender from being fully raised.

FIG. 21 shows a modified version of FIG. 17, according to one aspect of the system and method described herein. In approach 2100, camera 2101 is attached by stick 2102. Wire 2103 connects to controller box 1701, enabling transmission of images from the camera to show when the fender is lowered. When there is a problem raising the fender, camera view field 2104 can observe the state of the fender, such as, for example, if the fender is stuck on the sea bottom, if the fender line is tangled, etc. It is clear that wire 2103 could be run within stick 2102, or the camera could be placed in a bulge out of the top of controller 1701, etc. Various different cameras and viewing angles may be used to provide the best views of a problem. It is not necessary in all cases that the camera explicitly observes a tangle. It can be used, for example, simply to see whether the protection circuitry described above in the discussion of FIG. 20 has stopped the motor due to difficulty in raising the fender. In some cases, visual recognition software may be embedded in the camera module or in the central controller, so the system can identify either a tangle or a lack of motion of the fender, which, when the motor should be in motion, indicates highly likely a tangle or similar problem.

Figure 22:
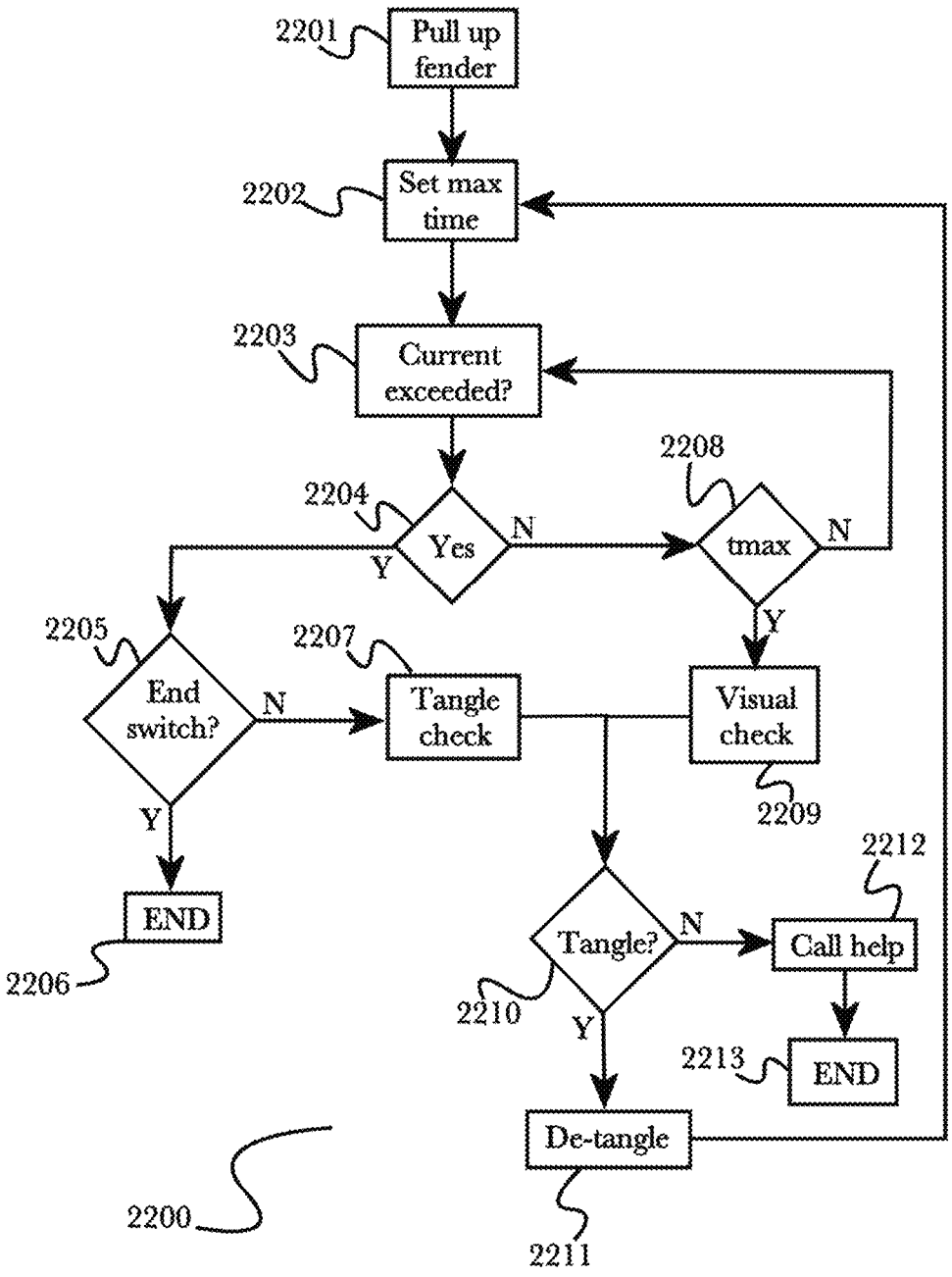
FIG. 22 shows a process for resolving problems with raising a fender.

FIG. 22 shows an exemplary process 2200 for resolving problems with raising the fender, employing the two novel approaches disclosed above in the discussions of FIGS. 20 and 21, according to one aspect of the system and method disclosed herein. In step 2201, the system receives a command to pull up the fender. In step 2202, the system sets a maximum time to attempt to pull up the fender, and in step 2203, the system monitors the time to determine when the current attempt exceeds the preset maximum time. If, in step 2204, the system determines that the current attempt has exceeded the preset maximum time, in step 2205 the system checks to see if an End switch, such as, for example, switch 711 described in the discussion of FIG. 7, is activated, signaling that the fender is fully retracted. The inventor envisions that various switching means may be used as an End switch 711 according to the invention; for example, conventional contact-based electrical switches, radio frequency identification (RFID) proximity switches, mechanical switches, magnetic switches, or any other similar means of detecting when a fender is fully retracted. Additionally, more than one end switch may be utilized in some arrangements, for example to increase reliability if the fender is retracted at an angle, or to provide redundancy should any single switch fail (for example, due to damage to the receptacle). If the End switch is activated, indicating that the fender or movable bar is fully retracted, in step 2206 the process ends. However, in step 2205, if the system detects that the End switch is not activated, in step 2207 the system initiates a check for a tangle in the fender line. In step 2210, the system checks to determine the number of tangle checks, such as, for example, the first occurrence of a tangle check, or any number up to a preset maximum. Typically, only one or two attempts to detangle would occur, to avoid damage to the equipment. If, in step 2210 the detangle attempts do not exceed the preset limit, in step 2211 the system attempts to detangle the line, typically by a little tug or pull on the line, as would be done manually. After each detangle attempt in step 2211, the system returns to step 2202 to repeat the process. If the maximum current is not exceeded in step 2204, then in step 2208 the system again checks to see if the maximum time or number of attempts has been exceeded. If the detangle attempts fail repeatedly, in step 2209 the system attempts a visual check of the fender, using the camera as described in the discussion of FIG. 21. When the visual check is finished, the system once again attempts a detangle. If all system detangle attempts fail, the system issues a call for operator help in step 2212, and in step 2213 the process ends. Different strategies for detangling may be used, for example resulting in controlled jerking of the line and or the fender in order to resolve the tangle or jam. There may also time limits for individual sets of detangling and overall attempts in order to protect the components of the system from overload/damage. Further, failure to complete retraction may result in an alert sent to an operator or other predetermined location or person.

In some cases, in a system with a retention device and a mechanism for stowing a boat fender, upon retracting the fender, the system shuts off the motor if an over-current arises due to a tangle in the line or a catch of the fender below the retention device. Upon such a shutdown of the motor, the system engages in a limited number of small reversals in an attempt to detangle the line and/or the fender and achieve a full retraction. Additionally, a camera and visual recognition software may be used to detect a tangle or other problem with the line or the fender, in addition to the current sensing. Further, upon attempting to retract the fender, the motor shuts off if a disturbance in the retraction motion is recognized by the visual recognition software due to a tangle in the line or a catch of the fender below the retention device. In such cases, the system engages in a limited number of reversals to attempt to detangle the line and or the fender and achieve a full retraction. Moreover, the current control may be used to aid the detangling control of the reversal of the line motion in addition to the camera. Different strategies for detangling may be used. There may also time limits for individual sets of detangling and overall attempts in order to protect the components of the system from overload/damage. Further, failure to complete retraction may result in an alert sent to an operator or other predetermined location or person.

Figure 23:
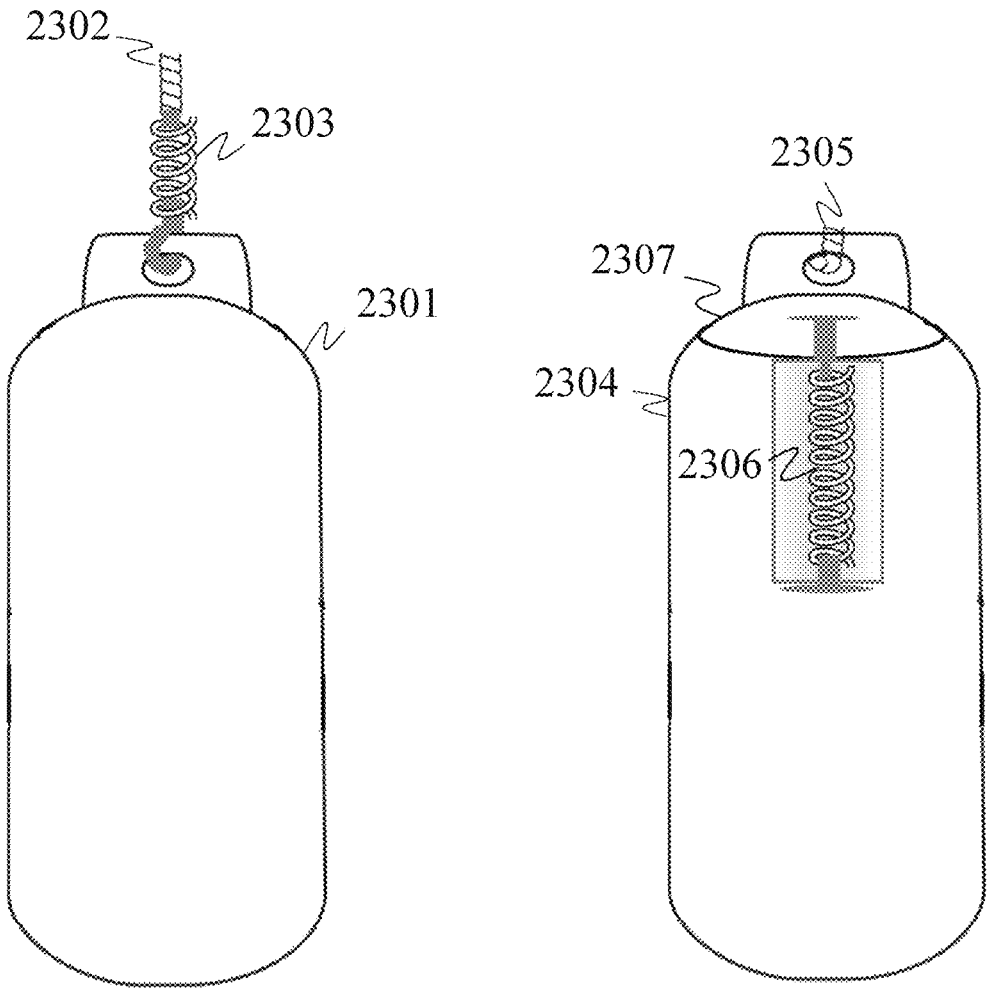
FIG. 23 shows a pair of embodiments with elastic members to mitigate forces transmitted from a fender to a mechanism of the invention.

FIG. 23 shows exemplary embodiments of the invention adapted to provide protection for boat fender system 2300. During the course of boat use, storms or other disturbances may occur that result in the production of heavy swells or waves. These swells can possess enough energy to damage the machinery of either manually operated or motor operated fender systems, particularly when sudden movement of a vessel causes substantial tension to be applied suddenly to any cable holding a fender in place, thereby placing large and sudden stresses on the machinery of fender systems. Such tension may happen even in calm days but when the boat doesn't stop immediately when arriving at the dock or in a case the boat is arriving at higher speed than in normal docking operation. The effects of heavy swells may operate both while the fenders are retracted—where the confines of the retention device can serve to exacerbate the strength of the swell—and while the boat is docked—where the swells can exert significant tugging pressure or the fender can get caught between the dock and hull of the boat moving independently of each other, again tugging at the fender with significant force. According to the embodiments shown in FIG. 23, mechanisms that use elastic members situated between a fender 2301 and a line 2302 act to mitigate these forces before damage occurs to the rest of the system. In a preferred embodiment, boat fender 2301 is attached to a spring 2303, and the other end of the spring attached to line 2302, which goes to the rest of the system. Spring 2303 acts as a buffer between fender 2301 and the rest of the system. While a spring is shown and described, one knowledgeable in the art will realize that other elastic members (such as, but not limited to, bungee cords or bungee cables) could be used for the purpose of swell mitigation. In a second preferred embodiment of the invention, fender 2304 is equipped with a detached top 2307 which can move freely from the rest of fender 2304. Detached top 2307 is attached to the rest of fender 2304 by a spring 2306 internal to fender 2304; spring 2306 has a point of attachment to fender 2304 at its lower end, in the interior of fender 2304. In times of heavy force upon fender 2304 by a swell, spring 2304 serves to buffer the forces by allowing the top of the fender to partially separate temporarily until the stress is relieved. Detached fender top 2307 is then attached to a line 2305 that goes to the rest of the system. Alternatively, an internal spring 2306 may be used without detached top 2307, in which case spring 2306 may be connected directly to line 2305. It should be clear that the examples depicted in these figures are relatively simple configurations practical to clearly show the functional aspects of the system; other structures and parts such as but not limited to protective encasements, retainers, correct mounting hardware, drains, and guides are not depicted. Relative lengths or sizes of the parts are not meant to be to scale for operation.

In some embodiments, the rate of raising fender 1711 may be slowed when fender 1711 approaches an intermediate position; that is, intermediate between a deployed position and a stowed position. In a preferred embodiment, as fender 1711 just begins to enter the retention device (e.g., retention device 1701), the rate of raising fender 1711 is reduced, to reduce the likelihood of fouling and to potentially reduce the impact resulting from any misalignment, fouling, or other problem. It will be recognized by one having ordinary skill in the art that various means of detecting when to change (e.g., reduce) the rate of raising of fender 1711 may be used according to the invention. For example, a time duration of raising may be used or, if a stepper motor is used, a count of the number of steps during the raising of fender 1711 may be used. Additionally, various switches, such as electromagnetic proximity switches of mechanical switches, may be placed so that they send a signal to the control system as fender 1711 passes, for example, the lower end of retention device 1701 while being raised. In some embodiments, retention device 1701 may be partially open, with a lower circumferential ring at its lowest opening, a partially closed cylindrical portion above this lower circumferential ring, and a fully closed upper portion. In such embodiments, lowering of the rate of raising of fender 1711 into retention device 1701 would typically occur as the top of fender 1711 enters the lower ring of retention device 1701. Other variations are clearly possible, according to the invention, as will be appreciated by one having ordinary skill in the art.

Figure 24:
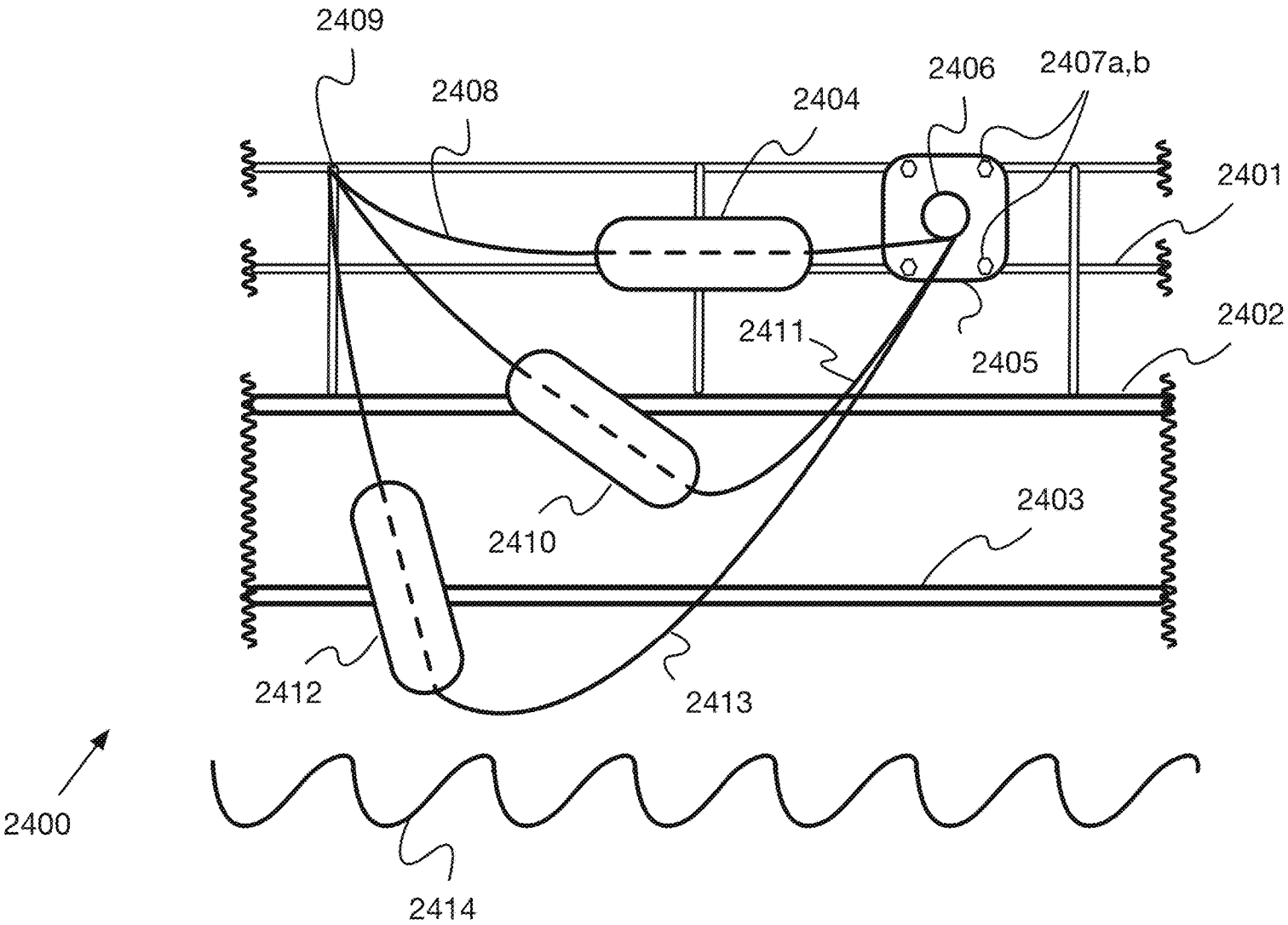
FIG. 24 shows an exemplary embodiment of a reduced-complexity fender positioning system with a single motor unit mechanism of the invention.

FIG. 24 shows an exemplary embodiment of a reduced-complexity fender positioning system with a single motor mechanism. FIG. 24 shows an overview 2400 with a railing 2401, a deck side 2402, and a rub edge 2403 of a boat above the waterline 2414 (all partial view cutouts). Further, a fender 2404 in retracted position (with a dotted line indicating the center hole) is shown, and a line 2408 that passes through the fender's center hole. Line 2408 is attached at one end to a fixed location of the boat, for example the railing 2409. That fix location may be the boat cleat, the stanchion or any other boat part. In some cases one may connect that fix location directly to the boat using a screw, a glue, a vacuum or some other mechanism. The other end of line 2408 may be connected to a spool or winding drum or some other mechanism 2406 attached to a motor unit 2405 which may be attached to the boat railings 2401 with screws or bolts or zip ties or some other attaching mechanism 2407*a,b*. The motor 2405 in the unit may be operable with a switch or a controller for example using battery, solar charger, wireless control etc. as described herein, to pull up the fender 2404 into a top resting position whereupon, while retracting fender 2404, the motor 2405 may be configured to detect changes in current or other means such as a switch, and is configured to change its operation if change in state is detected for example an overcurrent or change in current state is detected. Fender 2404 is also shown in lower positions, such as 2410 and 2412. These are not additional fenders to fender 2404, but one and the same, in different positions based on line loop extensions as indicated by longer lines loops 2411 and 2413 respectively. The line comes out of the spool or winding drum or another winding mechanism 2406 on motor unit 2405. Further, in some cases state detection (current, switch or other) is based at least in part on a configured current limit. Also, in some other cases an overcurrent condition or change in current state may be caused by a tangle in the line 2408. Furthermore, in yet other cases, upon current change detection, the system attempts to achieve a full retraction to the rest position by reversals of line 2408 movement. In yet other cases, a camera (not shown) with visual recognition software is used instead of or in addition to current sensing. In some cases, if fender 2404 retraction fails after the number of reversals, an alert is provided to an operator. In several of the herein described cases, after the user selects a height, the time to reach said height is changed based on the voltage of the batteries, to compensate for the actual speed of the motor 2405. Further, in some cases, the system deploys to a previously determined height upon approaching a previously set area for docking. Positioning in this section mostly is relying on gravity and may be relying on friction. In some aspects flexible tubing (not shown) maybe added to the inside of the fender 2404 or around the line 2408 to better control friction. In some cases end pieces may be added with a funnel shape (not shown) to control friction and/or to improve longevity of fender 2404. In yet other cases, the line 2408 may have a special coating to control friction.

The skilled person will be aware of a range of possible modifications of the various embodiments described above. Accordingly, the present invention is defined by the claims and their equivalents.

What is claimed is:

1. A system for deploying or retracting boat fenders based on deployment location and lifting scenarios, comprising:

at least one motor; and a controller comprising a first plurality of programming instructions stored in a memory of, and operating on a processor of, a computing device, wherein the first plurality of programming instructions, when operating on the processor, cause the computing device to:

determine a geographical location of the boat; and activate the motor or motors to raise or lower a boat fender or fenders based on the geographical location of the boat.

2. The system of claim 1, wherein the activation is after or inline with an operator prompt.

3. The system of claim 2, wherein the controller further comprises a second plurality of programming instructions stored in the memory of, and operating on the processor of, the computing device, wherein the second plurality of programming instructions, when operating on the processor, cause the computing device to:

receive a decision of a user of the system regarding fender deployment; and remember the decision of the user.

4. The system of claim 1, wherein the computing device is a smartphone, a navigation plotter, a GPS device, a tablet, an industrial computerized device, a device deigned to operate as boat controller or a device modified to work as boat controller, or an embedded computing system on the boat itself, on a boat fender system, or on any other equipment on the boat, and wherein the computing device may be a single device or may be a network of devices.

5. The system of claim 1, wherein the system calculates boat fender deployment location based on information comprising boat location or map data.

6. The system of claim 1, wherein the system adjusts boat fender deployment height based on a docking location.

7. The system of claim 6, wherein actual boat fender deployment heights data for a specific docking event are stored on a server for use by other system users.

8. The system of claim 1 further comprising a planning application that allows a plurality of future docking sites or areas to be specified by a user; and may allow the user to set a planned boat fender deployment height for each specified docking site and time.

9. The system of claim 1, wherein the boat fender is raised or lowered to the correct level after, or regardless of, an operator acknowledgement based on cruising speed.

10. A system for deploying or retracting a boat fender, comprising:

at least one motor;

at least one line fastened to the motor; and a controller comprising a first plurality of programming instructions stored in a memory of, and operating on a processor of, a computing device, wherein the first plurality of programming instructions, when operating on the processor, cause the computing device to:

activate the motor or motors to raise or lower a boat fender; and direct operation of one or more systems to raise or lower a boat fender.

11. The system of claim 10, wherein the controller is configured to detect failures to deploy or retract.

12. The system of claim 11, wherein the detection of the failure to deploy or retract is based on changes in motor current, and operation of the system is changed based on the change in current.

13. The system of claim 11, wherein upon the detection, the system attempts to achieve a full deployment or retraction by reversals of line movement.

14. The system of claim 10, wherein the system updates the boat fender deployment height in response to a tidal information or by sensing height relative to a dock or water.

15. The system of claim 14, wherein the system updates the boat fender deployment height in response to a tidal information or by sensing height relative to the dock or water.

16. The system of claim 10, wherein the boat fender is attached to a line attached to a winch coupled to a motor.

17. The system of claim 16, wherein the winch is replaced by a pulley or a spool.

18. The system of claim 10, further comprising a retention device for guiding, holding, or retaining a boat fender.

19. The system of claim 10, wherein the line is connected to the fender by a spring or elastic component.

20. The system of claim 10, wherein a lever is used to initiate, stop, or reverse the swinging out of the fender or the fender retrieval system.

21. The system of claim 10, wherein an additional motor is used to assist the initiation, stopping, or reversing the swinging out of the fender or the system.

22. The system of claim 10, wherein a safety release is added to the line, wherein if the force on the line is higher than a preset value, the safety release activates and disconnects the line.

* * * * *